US005390097A

United States Patent [19]

Nino

[11] Patent Number: 5,390,097

[45] Date of Patent: * Feb. 14, 1995

[54] REFLECTOR FOR VEHICULAR HEADLIGHT

[75] Inventor: Naohi Nino, Shizuoka, Japan

[73] Assignee: Koito Manufacturing Co., Ltd., Tokyo, Japan

[ * ] Notice: The portion of the term of this patent subsequent to Nov. 23, 2010 has been disclaimed.

[21] Appl. No.: 236,248

[22] Filed: May 2, 1994

Related U.S. Application Data

[60] Continuation of Ser. No. 70,687, Jun. 2, 1993, abandoned, which is a division of Ser. No. 808,670, Dec. 17, 1991, Pat. No. 5,258,897.

[30] Foreign Application Priority Data

Jan. 25, 1991 [JP] Japan ..... 3-23830

[51] Int. Cl.[6] ..... F21V 7/00

[52] U.S. Cl. ..... 362/346

[58] Field of Search ..... 362/341, 346, 347, 348, 362/350

[56] References Cited

U.S. PATENT DOCUMENTS

| | | | |
|---|---|---|---|
| 1,788,934 | 1/1931 | Wood . | |
| 3,492,474 | 1/1970 | Yamaguchi et al. | 362/350 |
| 4,481,563 | 11/1984 | Snyder et al. . | |
| 4,612,608 | 9/1986 | Peitz . | |
| 4,754,374 | 6/1988 | Collot | 362/346 |
| 4,772,988 | 9/1988 | Brun . | |
| 4,945,454 | 7/1990 | Bunse et al. . | |
| 5,086,376 | 2/1992 | Blusseau | 362/347 |

FOREIGN PATENT DOCUMENTS

| | | | |
|---|---|---|---|
| 132363 | 4/1929 | Switzerland | 362/348 |
| 188142 | 11/1922 | United Kingdom | 362/346 |
| 2223566 | 9/1989 | United Kingdom . | |

*Primary Examiner*—Carroll B. Dority

*Attorney, Agent, or Firm*—Sughrue, Mion, Zinn, Macpeak & Seas

[57] ABSTRACT

A vehicular headlight reflector for forming a low beam light-distribution pattern by effectively utilizing the entire reflecting surface, and providing a light-distribution control function so that a pattern image generated substantially by a lower half surface of the reflector is located below the horizontal line and as close to the horizontal line as possible. A filament is arranged between a focus F of a reference parabola and a reference point D offset from the focus F so that its central axis extends in parallel with an axis passing through the parabola vertex O and the reference point D. A virtual paraboloid is assumed for each arbitrary point P on the reference parabola, the virtual paraboloid having an optical axis that extends in parallel with a light ray vector of a reflected light ray obtained when a light ray assumed to have been emitted from the reference point D and reflected at the point P, passing through the point P, and having the point D as its focus. A reflecting surface is formed as a collection of intersecting lines obtained when the virtual paraboloid is cut by a plane including the light ray vector and being parallel with the vertical axis (z-axis). Projected images of the light source are located so as to move around a rotation center on the horizontal line with a movement of representative points on an intersecting line in the reflecting surface.

5 Claims, 39 Drawing Sheets

FIG. 59 PRIOR ART
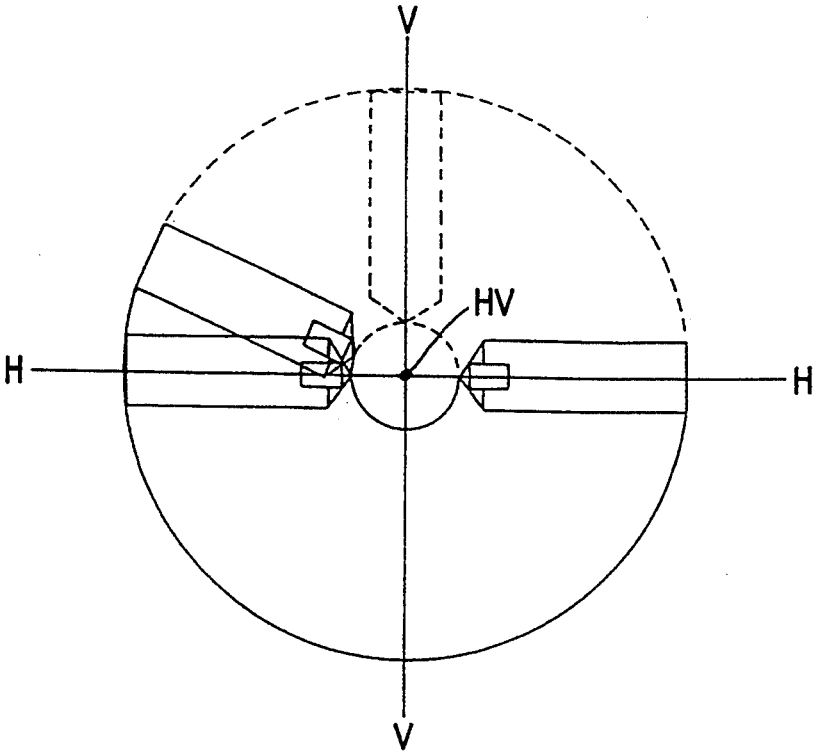
FIG. 60 PPIOR ART
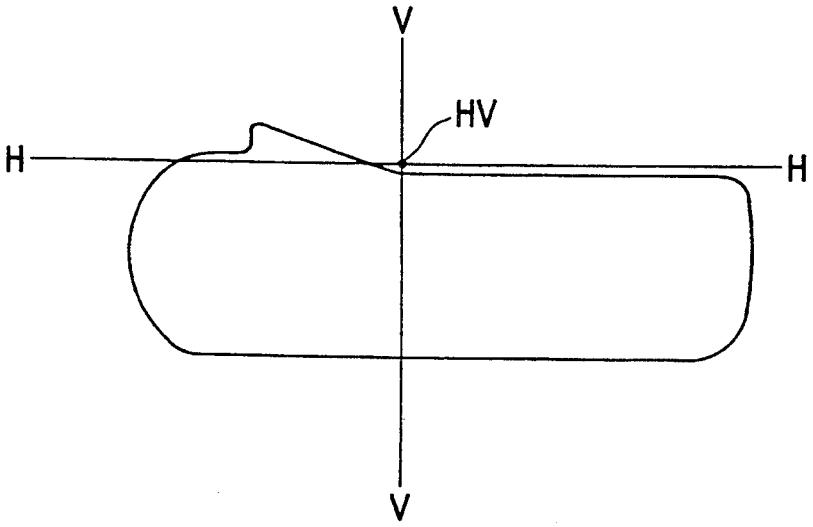

REFLECTOR FOR VEHICULAR HEADLIGHT

This a continuation of application Ser. No. 08/070,687, filed Jun. 2, 1993, and now abandoned, which is a division of application Ser. No. 07/808,670, filed Dec. 17, 1991, now U.S. Pat. No. 5,258,897.

BACKGROUND OF THE INVENTION

1. Industrial Application Field

The present invention relates to a reflector of a vehicular headlight having a light-distribution control function, which is capable of forming a light-distribution pattern having a cutline specific to a low beam by effectively utilizing the entire reflecting surface without arranging a light-shielding member near a light source.

2. Prior Art

FIG. 57 shows the most basic construction of a vehicular headlight to produce a low beam light distribution which conforms to industry standards. As shown, a coil-like filament c is arranged near the focus b of a paraboloid-of-revolution reflector a so that the filament's s central axis coincides with the optical axis of the reflector a (the optical axis is selected as the x-axis; a horizontal axis as the y-axis; and a vertical axis as the z-axis). This is called a C-8 type filament arrangement. Further, an outer lens d for light-distribution control is disposed in front of the reflector a.

Although the filament c is depicted in FIG. 57 as a cylinder with its front end being flat and its rear end (on the side of the focus b) having a pencil-like shape that is conical, this representation is just for convenience to clarify the direction of a projected image of the filament c. In the remainder of the disclosure, unless otherwise specified, the filament image should be considered as having a dimension only along the filament axis.

Reference character e designates a shade for forming a cutline. The shade e is disposed under the filament c, and serves to cut light rays directed to an approximate lower half $a_L$ of the reflector a as indicated by hatching in FIG. 58.

Thus, filament images formed by the reflector a become as shown in FIG. 59. And a pattern after being subjected to final light-distribution control by the outer lens d is as shown in FIG. 60.

FIG. 59 schematically shows the images of the filament c projected onto a screen disposed in front of the reflector a and away therefrom by a predetermined distance. In FIG. 59, "H—H" designates a horizontal line; "V—V", a vertical line; and "HV" an intersection of these lines.

As is understood from FIG. 59, since part of the light rays toward the reflecting surface are shielded by the shade e, the pattern without the use of the outer lens d assumes a fan-like shape (its central angle equals to 180° plus the cutline angle) which is formed by removing the portion above the H—H line except for the cutline portion (indicated by the dashed line in FIG. 59). The light-distribution pattern of FIG. 60 is obtained as a result of light diffusion in the horizontal direction by the outer lens d.

By the way, the streamlining (i.e., reduction of the aerodynamic resistance coefficient) of car bodies has been demanded from the viewpoint of aerodynamics for automobiles. And as the so-called "slant-nose" design gains popularity, a headlight of the type in which the outer lens is considerably inclined with respect to the vertical axis, tends to be used to match this design.

As the angle formed by the outer lens with respect to the vertical axis, i.e., a so-called slant angle, is increased, the light-distribution control function of the outer lens can no longer be relied upon. More specifically, a long tailing phenomenon becomes conspicuous (in both right and left end portions of a light-distribution pattern) which is caused by wide-diffusing lens steps formed on the outer lens.

As a recent trend, this problem is solved by giving the light-distribution control function, which has been assumed by the outer lens, to the reflector.

Preference to a reflector having the light-distribution control function is also supported from the standpoint of accommodating a low bonnet structure. That is, in a car body design in which the height from a bumper to the front end of a bonnet is not large, it is preferable to provide a headlight whose vertical dimension is small. However, with this headlight, there exists a problem in the luminous flux utilization rate. That is, the technique of forming a cutline with a shade does not allow the luminous flux to be utilized effectively. Therefore, it is desired to form a cutline without using a shade. To respond to such a demand, there has been conceived an idea of forming a cutline by using the entire surface of the reflector and by relying only on the configuration of the reflector. This means giving the reflector the light-distribution control function.

Various types of reflectors having the aforesaid light-distribution control function have been proposed, each having unique features, such as configuration, focus position, etc. In one example, a reflecting surface is divided into a plurality of reflecting sectors, and the focuses of the respective reflecting sectors do not coincide with one another but are offset on the main optical axis of the reflector. This construction is disclosed in U.S. Pat. No. 4,772,988.

However such conventional reflectors, having a light-distribution control function, also have a certain limitation in a light-distribution pattern produced by the lower reflecting sectors. This tends to cause the quantity of light immediately below the horizontal line H—H to be relatively small, thereby imposing a problem in luminous intensity distribution To illustrate this point, let us assume the model in which a paraboloid-of-revolution reflecting surface as shown in FIG. 57 is divided into two sectors, i.e., upper and lower sectors. Also assume their focuses are offset forward and backward on the optical axis, causing the two sectors to have different focal lengths. Specifically, the focus of the upper half surface of the reflector is located near the rear end of the filament, while the focus of its lower half surface is located near the front end of the filament.

FIG. 61 shows a pattern f produced by the reflector a when the shade e is not used (the reflector a has a single focus b). The upper half surface and the lower half surface are not symmetrical. Since a portion contributing to the formation of a cutline is included in the upper half side, a pattern g by the upper half surface and a pattern h by the lower half surface is asymmetrical with respect to the H—H line.

FIG. 62 shows a pattern i obtained by a reflector having two focus positions. A pattern j produced by the upper half surface is identical, in shape, with the pattern g of FIG 61, and is located in the same area. A pattern k produced by the lower half surface is identical, in shape, with the pattern h of FIG. 61 while 180°-rotated around the intersection HV, thus being located under the horizontal line H—H.

As is understood from FIG. 62, since the quantity of light is relatively lower in a region A immediately below the horizontal cutline than in a region B where the patterns j and k are superposed, a brightness variation becomes gentler toward the cutline, making it difficult to form a sharp cutline

SUMMARY OF THE INVENTION

To overcome the above problems, the present invention forms a reflecting surface, in the area responsible for the formation of images of a low beam light-distribution pattern below a horizontal line, as a collection of intersecting lines obtained when virtual paraboloids of revolution are cut by virtual planes, each virtual plane having a predetermined relationship with a corresponding virtual paraboloid of revolution.

The virtual paraboloid of revolution is a paraboloid which has a focus (reference point) that is offset by a predetermined distance from the focus of a reference parabola (the distance from the vertex of the reference parabola to the focus of the paraboloid is greater than the focal length of the reference parabola), and which has an optical axis that is parallel with a vector of a light ray after its reflection at a point on the reference parabola when the light ray is assumed to have been emitted from the focus of the paraboloid. Further, the virtual paraboloid contains that reflection point. Also, the virtual plane contains the reflection point and the light ray vector of the reflected light, and is parallel with a vertical axis.

These virtual paraboloids and planes exist for any arbitrary points on the reference parabola, and a collection of intersection lines of the virtual paraboloids and planes form a reflecting surface of the invention.

In the invention, if a light source is disposed along the axis passing through both the focus of the reference parabola and the reference point that is offset therefrom, and if images of the light source, which are due to any arbitrary points on the intersection line of a virtual paraboloid of revolution and the corresponding virtual plane, both being assumed for any point on the reference parabola, are projected onto a distant screen, the projected images are arranged below and adjacent to the horizontal line with a point on the horizontal line which are in accordance with the intersection lines as their center of rotation (excluding the point on the screen which corresponds to the vertex of the reference parabola). This is in sharp contrast to the case where the entire reflecting surface has the configuration of a paraboloid of revolution and projected images, which are formed when a light source disposed adjacent to the focus is projected after reflection by points on the intersecting line of the paraboloid of revolution and a plane parallel with the vertical axis, are arranged above and below the horizontal line with symmetrical orientation with the point on the screen corresponding to the vertex of the reference parabola as the center of rotation.

That is, if a reflecting surface of the invention is applied to the lower half surface of the reflector, images of a light source projected by the lower half surface are located below the horizontal line and their luminous intensity distribution exhibits a peak at a portion close to the horizontal line.

Therefore, according to the invention, a prescribed low beam pattern can be produced without using a shade or the like, i.e., effectively utilizing the entire reflecting surface with its light-distribution control function. Thus, it is possible to form a sharp cutline, and there is no significant deviation in the distribution of luminous intensity downward from the horizontal line.

According to one feature of the invention, with respect to the configuration of a reflecting surface that serves to form a pattern image below the horizontal line of a light-distribution pattern, when images of a light source are projected onto a distant screen disposed in front of the reflecting surface by representative points on the reflecting surface in the vertical axis direction, the respective images are located close to one another immediately below the horizontal line with a point on the horizontal line but not on an extension of the main optical axis of the reflecting surface as the center of rotation. Therefore, it is possible to provide a reflector having a light-distribution control function using the entire surface thereof while using no light-shielding member that partially covers the light source. In addition, the center of the luminous intensity distribution can be located below the horizontal line and as close to the horizontal line as possible.

According to a further feature of the invention, a reflecting surface consists of a first sector formed into a paraboloid of revolution and occupying substantially the upper half surface, second and third sectors occupying substantially the lower half surface. The first sector is such that light rays reflected from a portion close to the boundary with the second sector contributes to the formation of a cutline; the second sector has the configuration of a reflecting surface in which a parabola obtained when its boundary line with the first sector is orthogonally projected onto a horizontal plane is employed as a reference parabola; and the third sector has the configuration of a reflecting surface in which a parabola on a plane parallel with the horizontal line forms a boundary line with the first sector, and serves as reference parabola. Therefore, a sharp cutline specific to a low beam can be produced only by the light-distribution control function of the reflecting surface, or with only slight aid of an outer lens.

According to yet another feature of the invention, undulations are formed on an entire reflecting surface as a means for providing a reflecting surface with a diffusion effect in the horizontal direction. The provision of the diffusion effect is accomplished by adding to an equation expressing the reflecting surface a function given by the product of a normal distribution type function and a periodic function so that the diffusion effect is enhanced by increasing the difference in height of the surface at the central portion of the reflecting surface at which the normal distribution type function takes its maximum value, and that the diffusion effect is reduced toward the periphery. This feature is particularly effective for slanted headlights in which a satisfactory diffusion effect by lens steps of a front lens cannot be expected. This feature is also effective in suppressing glare, and provides the advantage that designing of the reflecting surface is easier than that in forming recesses on a conventional reflecting surface.

BRIEF DESCRIPTION OF THE DRAWINGS

FIG. 59 is a diagram schematically showing filament images by the reflector shown in FIG. 58;

FIG. 60 is a diagram showing a light-distribution pattern formed by a headlight having the reflector shown in FIG. 58;

DESCRIPTION OF THE PREFERRED EMBODIMENTS

A reflector of a vehicular headlight according to embodiments of the present invention will be described in detail with reference to the accompanying drawings.

Prior to a detailed description, the configuration of the reflecting surface will be outlined.

To present a basic concept of the invention, the difference between a variation of projected filament images with a change of positions on the reflecting surface of the invention and a corresponding variation in the case of a conventional reflecting surface of a paraboloid of revolution will be clarified by making a comparison of the two.

Figure 1:
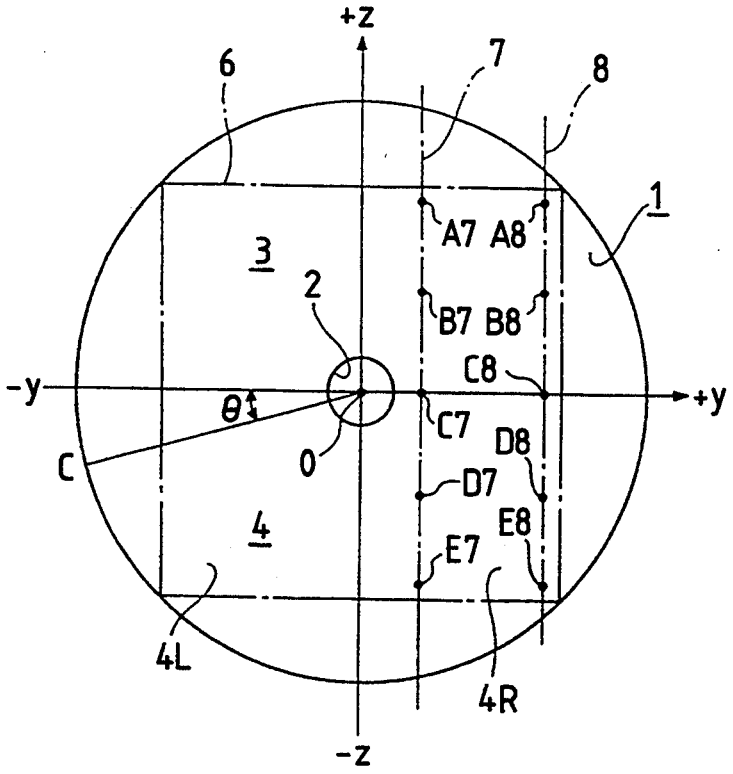
FIG. 1 is a schematic front view showing a reflecting surface.

FIG. 1, which will be referenced for a description of the conventional surface and the invention, is a schematic front view when a reflecting surface 1 is viewed from a point on its optical axis (if this axis is selected as the x-axis, the x-axis extends perpendicular to the drawing sheet). An axis orthogonal to the x-axis and extending in a horizontal direction is selected as the y-axis, and an axis perpendicular to the x-axis and extending in a vertical direction is selected as the z-axis. The origin O of this orthogonal coordinate system is located at the center of a bulb mounting hole 2.

In FIG. 1, an angle $\theta$, formed between a plane including both a line segment OC and the x-axis and the y-axis, corresponds to the "angle of cutline". The reflecting surface 1 is divided into two (upper and lower) reflecting sectors 3, 4, by this plane ($y<0$) and the x-y plane ($y>0$).

Figure 2:
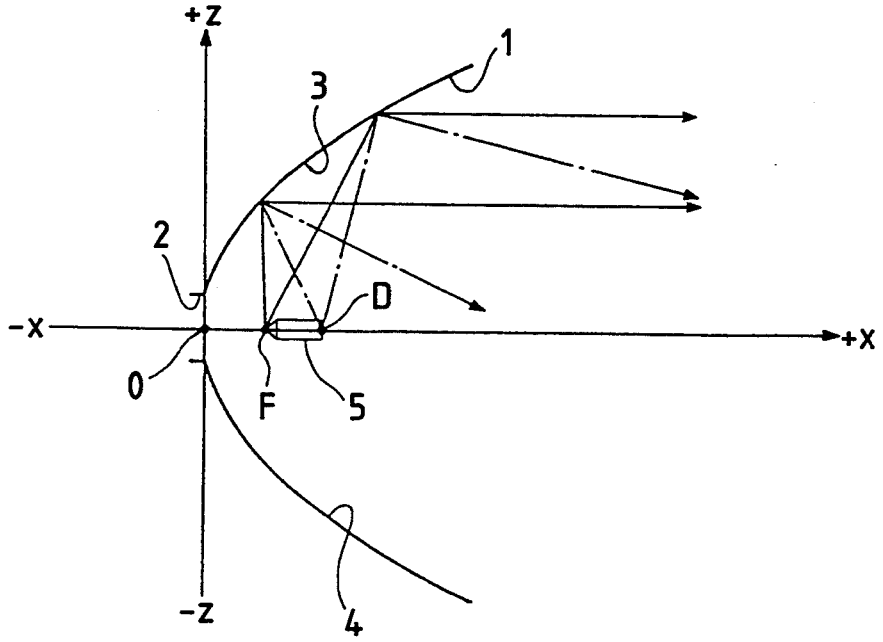
FIG. 2 is a schematic diagram showing the arrangement of a filament.

The upper reflecting sector 3 is a part of a paraboloid of revolution that has a focus F, as seen in FIG. 2, which is offset from the origin 0 by a distance f in the positive direction of the x-axis.

The lower reflecting sector 4 is further divided into two sectors 4L, 4R. In the case of a paraboloid-of-revolution reflector, the reflecting sector 4 is, of course, a part of a paraboloid of revolution having the point F as a focus and there is no difference between sectors 4L and 4R. When structured in accordance with the present invention, there are significant differences between the two sectors 4L and 4R.

A variation of projected images of a filament 5 in the case of the paraboloid-of-revolution reflector will be described first.

In this case, as shown in FIG. 2, the filament 5 is disposed between the point F and a point D (a point offset from the point F by a distance d in the positive direction of the x-axis). To clarify the orientation of the filament 5 just for convenience, the end portion of the filament 5 which is on the point F side is drawn as a cone and the end portion on the point D side as a flat surface.

How filament images are projected onto a screen distant from the reflecting surface 1 may be described, assuming a square region 6 indicated by the one dot chain line in FIG. 1. Filament images will be considered which are produced from: (1) five representative points on a line 7 that is defined by the intersection of a surface having a constant y-coordinate and being close to the origin 0 in the sector 4R on the right side (i.e., $y>0$), and the reflecting surface 1; and (2) five representative points on a line 8 that is defined by the intersection of a surface having a constant y-coordinate and being close to the right end of the sector 4R and the reflecting surface 1.

The representative points on the intersection line 7 are designated, in the order of their z-coordinate values, as points A7, B7, C7, D7 and E7, with points A7, B7 belonging to the sector 3, point C7 having a y-coordinate of zero, and points D7, E7 belonging to the sector 4R. Points A7 and E7, and points B7 and D7 have the same absolute z-coordinate values, respectively. The representative points on the intersection line 8 are designated, in the order of their z-coordinate values, as points A8, B8, C8, D8 and ES, with points A8, B8 belonging to the sector 3, point C8 having a y-coordinate value zero, and points DS, E8 belonging to the sector 4R. Points A8 and E8 and points B8 and D8 have the same absolute z-coordinate values, respectively.

Figure 3:
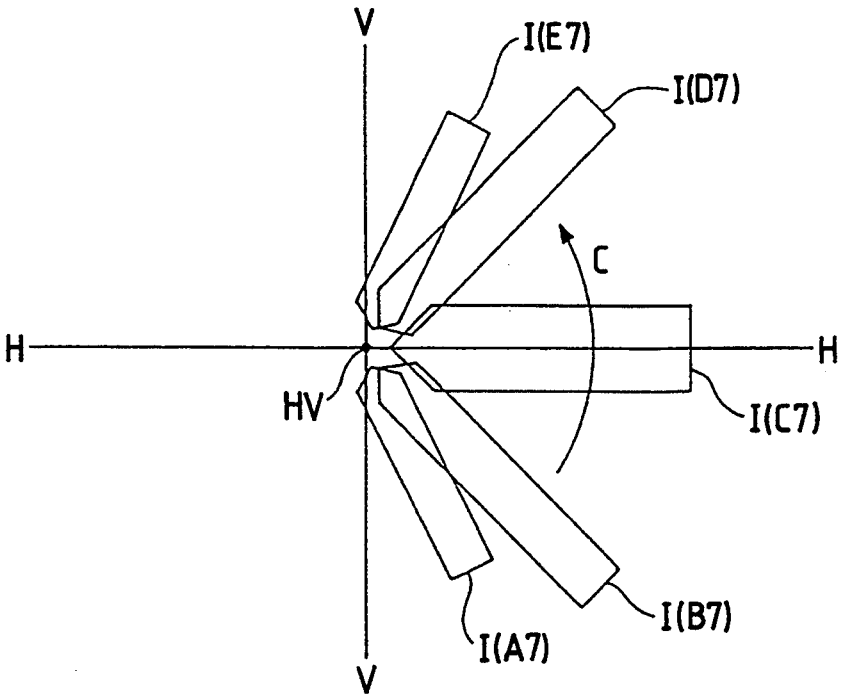
FIG. 3 is a diagram showing the arrangement of filament images projected by representative points on an intersecting line 7 shown in FIG. 1 in the case where the reflecting surface is a paraboloid of revolution.
Figure 4:
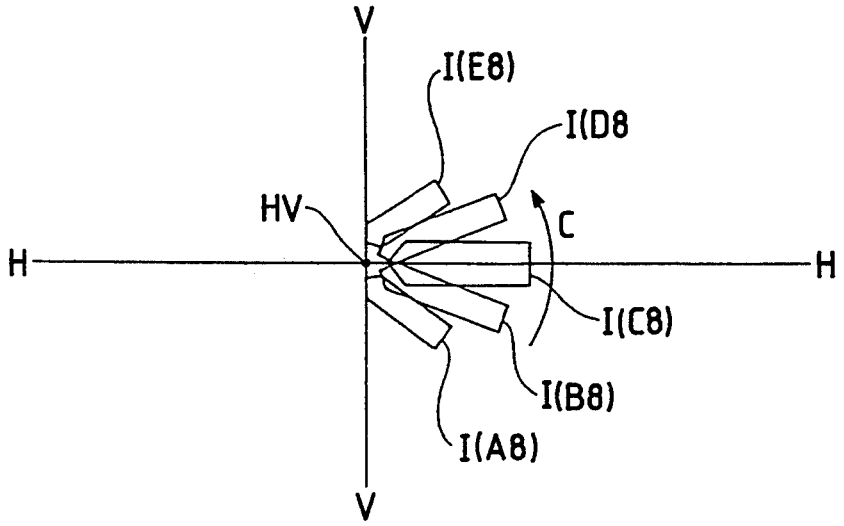
FIG. 4 is a diagram showing the arrangement of filament images projected by representative points on an intersecting line 8 which are different from those of FIG. 3.

FIGS. 3 and 4 schematically show the arrangements of filament images in the case where the reflecting surface 1 is a paraboloid of revolution. FIG. 3 shows filament images by the respective representative points on the intersection line 7, while FIG. 4 shows those by the representative points on the intersection line 8.

In FIGS. 3 and 4, I(X) represents a filament image by a representative point X parenthesized. Although the size of the filament images is different between FIGS. 3 and 4, there is observed, in either case, a tendency that the images are arranged with an intersection HV of the horizontal line H—H and the vertical line V—V as a center of rotation. That is, as the representative point moves in the order of A7 (A8), B7 (B8), C7(C8), D7(DS) and E7 (E8) starting from the top, the filament image rotates counterclockwise around the point HV from below the horizontal line H—H as indicated by arrow C with its pointed end constantly facing the point HV.

Figure 5:
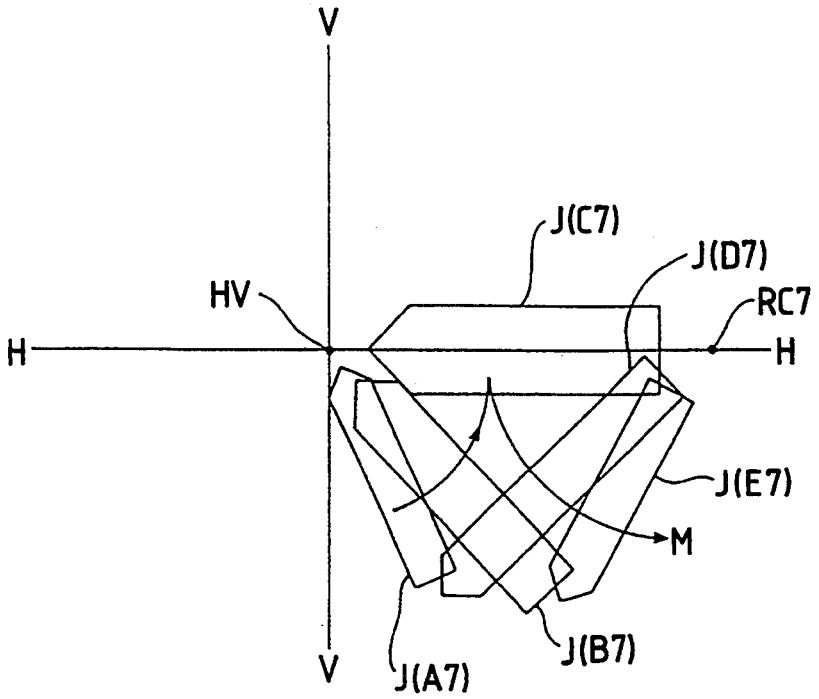
FIG. 5 is a diagram showing the arrangement of filament images projected by the representative points on the intersecting line 7 shown in FIG. 1 in the case where the upper half of the reflecting surface is a paraboloid of revolution and its lower half is a surface of the invention.
Figure 6:
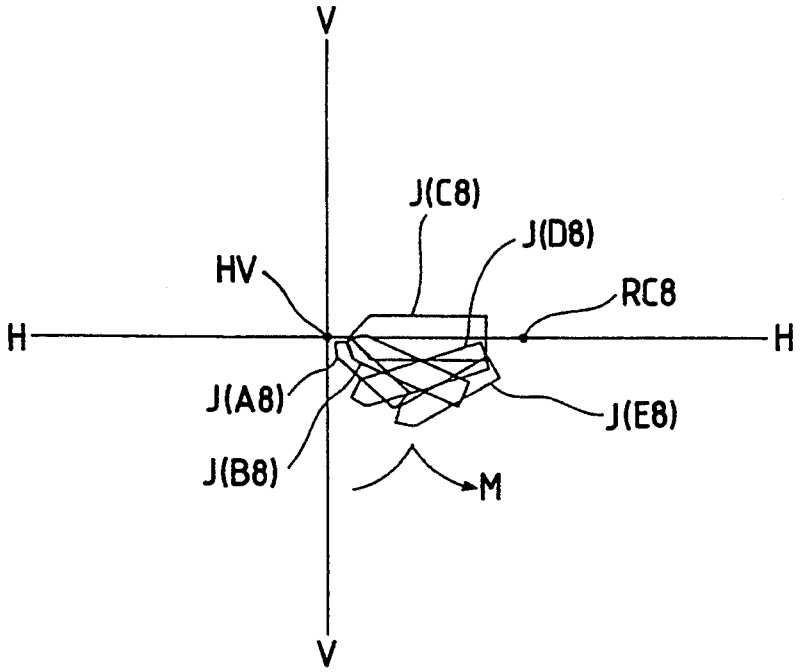
FIG. 6 is a diagram showing the arrangement of filament images projected by the representative points on the intersecting line 8 which are different from those of FIG. 5.

FIGS. 5 and 6 schematically show the arrangements of filament images in the case where the reflecting surface 1 consists of the reflecting sector 3 that is one of the two halves of a paraboloid of revolution, and the reflecting sector 4 of the invention. FIG. 5 shows filament images by the respective representative points on the intersecting line 7, while FIG. 6 shows filament images by the respective representative points on the intersecting line 8.

In FIGS. 5 and 6, J(X) represents a filament image by a representative point X parenthesized. As is apparent from the fact that the sector 3 is a halved paraboloid of revolution, the filament image rotates around the point HV as the representative point moves in the order of A7(A8), B7(B8) and C7(C8). On the other hand, the filament image rotates around a point RC7 that is away from the point HV by a predetermined distance on the horizontal line H—H, with the movement of the representative point from D7 to E7. The filament image rotates around a point RC8 that is away from the point HV by a predetermined distance on the horizontal line H—H (RC8 is farther away from the point HV than from the point RC7), with the movement of the representative point from D8 to ES.

Since the filament images vary substantially the same way in both of FIGS. 5 and 6, a description will be made with reference to FIG. 5, which has larger images. As the representative point moves in the order of A7, B7 and C7 starting from the top, the filament image rotates counterclockwise around the point HV to be located on the horizontal line H—H. Thereafter, as the representative point descends from D7 to E7, the filament image rotates counterclockwise around the point RC7 below the horizontal line H—H as indicated by arrow M, staying immediately below the horizontal line H—H with its flat end side constantly facing the point RC7.

In the above example, the filament image rotates around the point RC7 or RC8 for the representative points in the reflecting sector 4, in which the representative points are on the specified intersection line 7 or 8. However, it is apparent that if another intersection line is selected, another center of rotation exists on the horizontal lines H—H corresponding to the selected intersection line. Therefore, the centers of rotation exist infinitely on the horizontal line H—H in accordance with the respective intersection lines.

Figure 7:
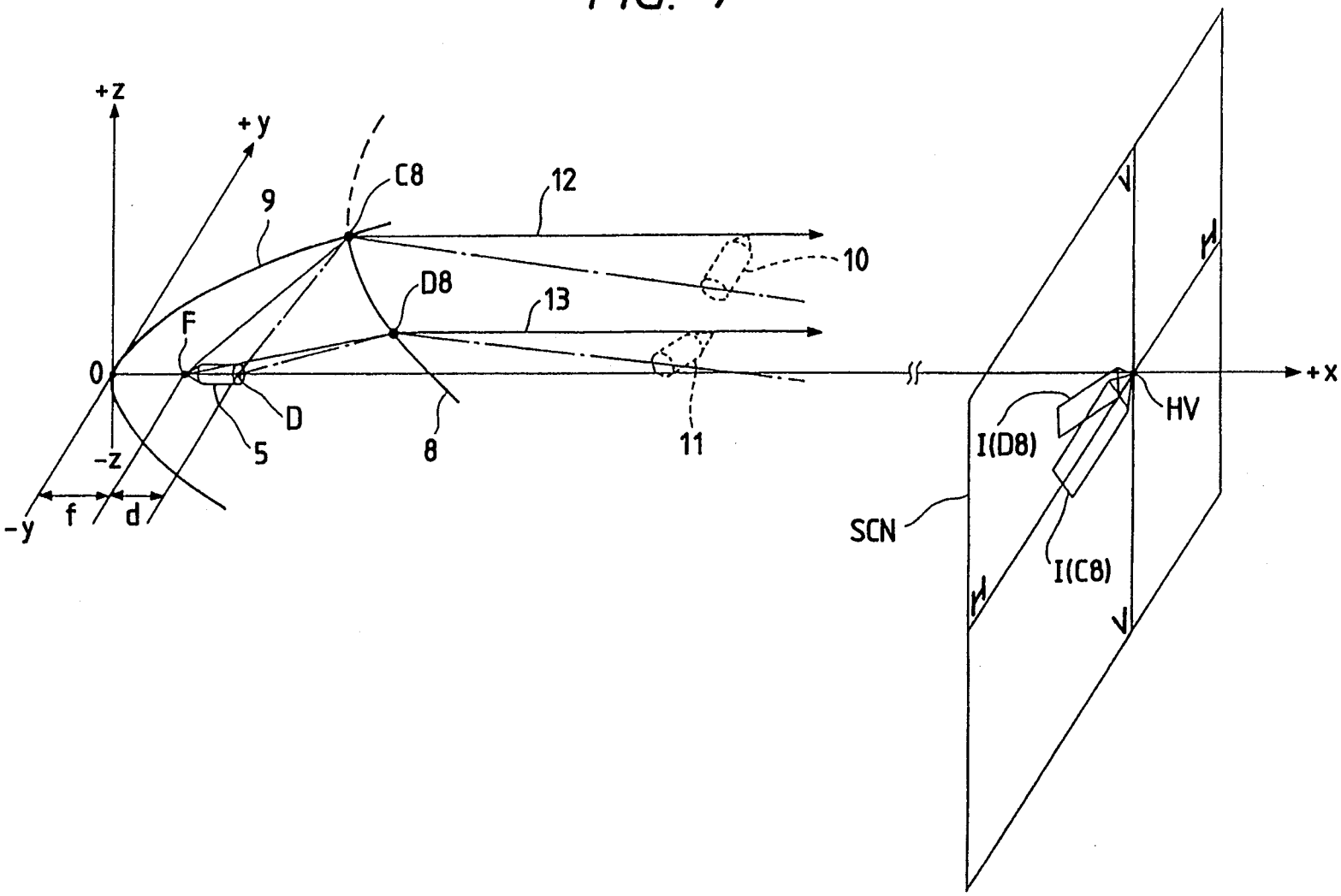
FIG. 7 is an optical path diagram for the reflecting surface of a paraboloid of revolution.
Figure 8:
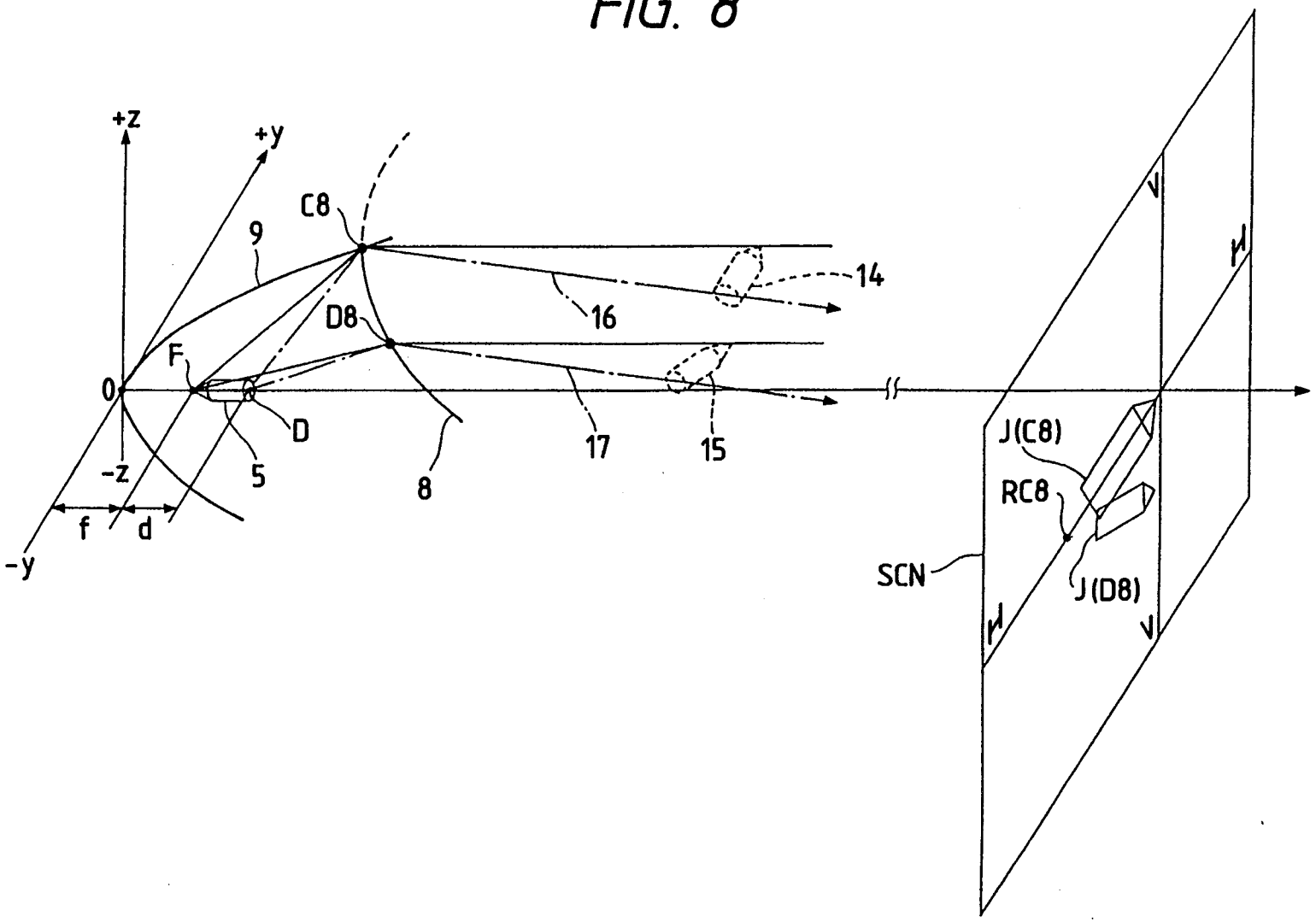
FIG. 8 is an optical path diagram for the reflecting surface of the invention.

FIGS. 7 and 8 qualitatively indicate why there exists a difference in the filament image movement depending on whether the sector 4 is a paraboloid of revolution or a reflecting surface of the invention.

FIG. 7 is an optical-path diagram showing projected images of the filament 5 by the representative points C8, D8 in the lower reflecting sector 4R in the case where the reflecting surface 1 is a paraboloid of revolution.

As is understood from FIG. 7, the point C8 is located on a parabola 9 in the x-y plane, and a filament image by the representative point C8 is projected as an image I(C8) onto a distant screen (SCN). A virtual image 10 on its way to the screen SCN is indicated by the broken line.

The representative point D8 is located below the representative point C8 on the intersection line 8, and a filament image I(D8) by this representative point D8 is projected onto the screen SCN, while a virtual image 11 on its way to the screen SCN is indicated by the broken line.

In FIG. 7, since the parabolic intersection line 8 has an optical axis that is identical with the x-axis, both a light ray 12 that is emitted from the point F and then reflected at the representative point C8 and a light ray 13 that is emitted from the point F and then reflected at the representative point D8 travel substantially in parallel with each other.

The filament image I(C8) from the representative point C8 is produced so that its longitudinal central axis extends in parallel with the horizontal line, while the filament image I(D8) from the representative point D8 is produced so that its longitudinal central axis is inclined by an angle with respect to the horizontal line. However, the light rays corresponding to the respective pointed ends of the virtual images 10, 11 (the pointed ends lie on substantially parallel rays 12, 13 and are in a plane comprising the rays 12, 13 and the horizontal line H—H) travel substantially in parallel with each other and meet at a greatly distant point. This causes the filament image to rotate around the point HV.

On the other hand, where the lower reflecting sector 4 is a reflecting surface of the invention, the situation is as shown in FIG. 8. With respect to the virtual images (indicated by broken lines) formed on the way to the screen SCN where the filament images are projected, an image 14 from the representative point C8 travels in parallel with the horizontal line while an image 15 from the representative point D8 is inclined by an angle to the horizontal line. These images are oriented in the same way as virtual images 10 and 11 in FIG. 7. But there is a significant difference. Specifically, a light ray 16 that is emitted from the flat end at point D and then is reflected at the representative point C8 travels substantially in parallel with a light ray 17 that is emitted from the point D and then is reflected at the representative point D8. That is, the shape of the intersecting line 8 is determined so that the light rays corresponding to the respective flat ends of the virtual images 14, 15 travel substantially in parallel with each other. Thus, the filament image rotates around the point RC8, at a distant position at which these substantially parallel rays eventually meet.

As understood from the previous discussion where the reflecting surface 1 is a paraboloid of revolution, the filament image always moves around the point HV as shown in FIG. 7 in accordance with the reflecting position on the reflecting surface 1, so the filament images by the reflecting sector 4 cannot be used as a low beam light-distribution pattern. On the other hand, where the reflecting sector 4 is a reflecting surface of the invention, the filament images generated by the reflecting sector 4 concentrate immediately below the horizontal line H—H with points (except for the point HV) on the horizontal line H—H as centers of rotation as shown in FIGS. 5 and 6.

Now, a reflecting surface of the invention will be expressed quantitatively using formulae. To facilitate the understanding, at the first stage no discussion will be made on the cutline specific to a low beam, but the case will be described where the reflecting surface 1 consists of an upper reflecting sector 3, being a halved paraboloid of revolution, and a lower reflecting sector 4 that will be discussed in detail.

The configuration of the reflecting surface to be applied to the reflecting sector 4 should satisfy the following two conditions a) and b).

a) Continuity condition: The reflecting sectors 3 and 4 are smoothly connected to each other without forming a step at the boundary therebetween (a cross section by the x-y plane).

b) Filament image arrangement condition: The filament images by the reflecting sector 4 are located below the horizontal line H—H and as near to the horizontal line H—H as possible.

The continuity condition a) is necessary to prevent generation of glare that would be caused by the presence of a discontinuity between the reflecting sectors 3 and 4. The filament image arrangement condition b) is necessary to utilize effectively (i.e., without shielding) the reflected light from the reflecting sector 4 as light rays contributing to the formation of a light-distribution pattern.

The situation described above with reference to FIG. 8 will further be analyzed in connection with the condition b). That is, the fact that the filament image rotates around a point other than the point HV on the horizontal line H—H indicates that the light rays 16, 17 emitted from the point D and reflected at the points on the intersecting line 8 travel in parallel with each other at all times, and that this relationship is satisfied for any arbitrary intersection line.

Figure 9:
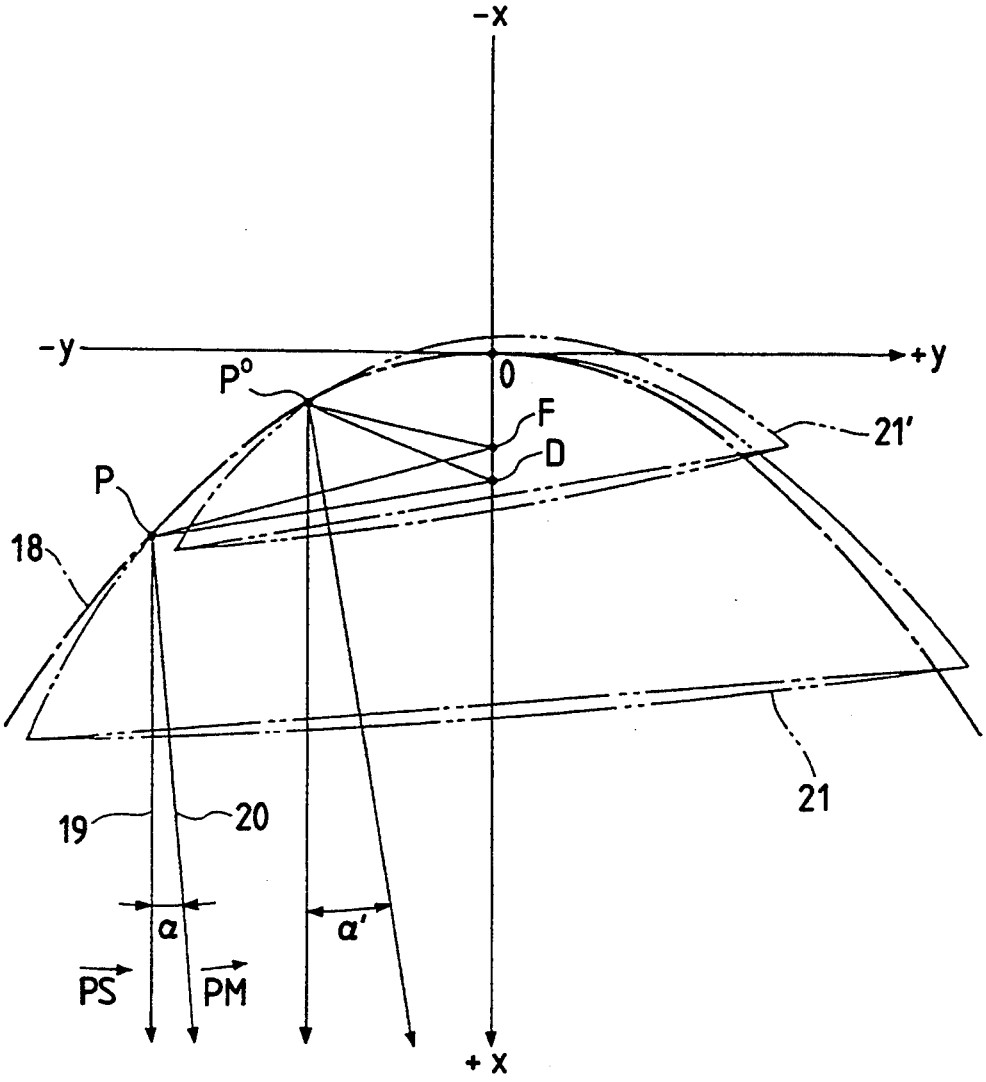
FIG. 9 is a schematic plan view illustrative of the reflecting surface of the invention.
Figure 10:
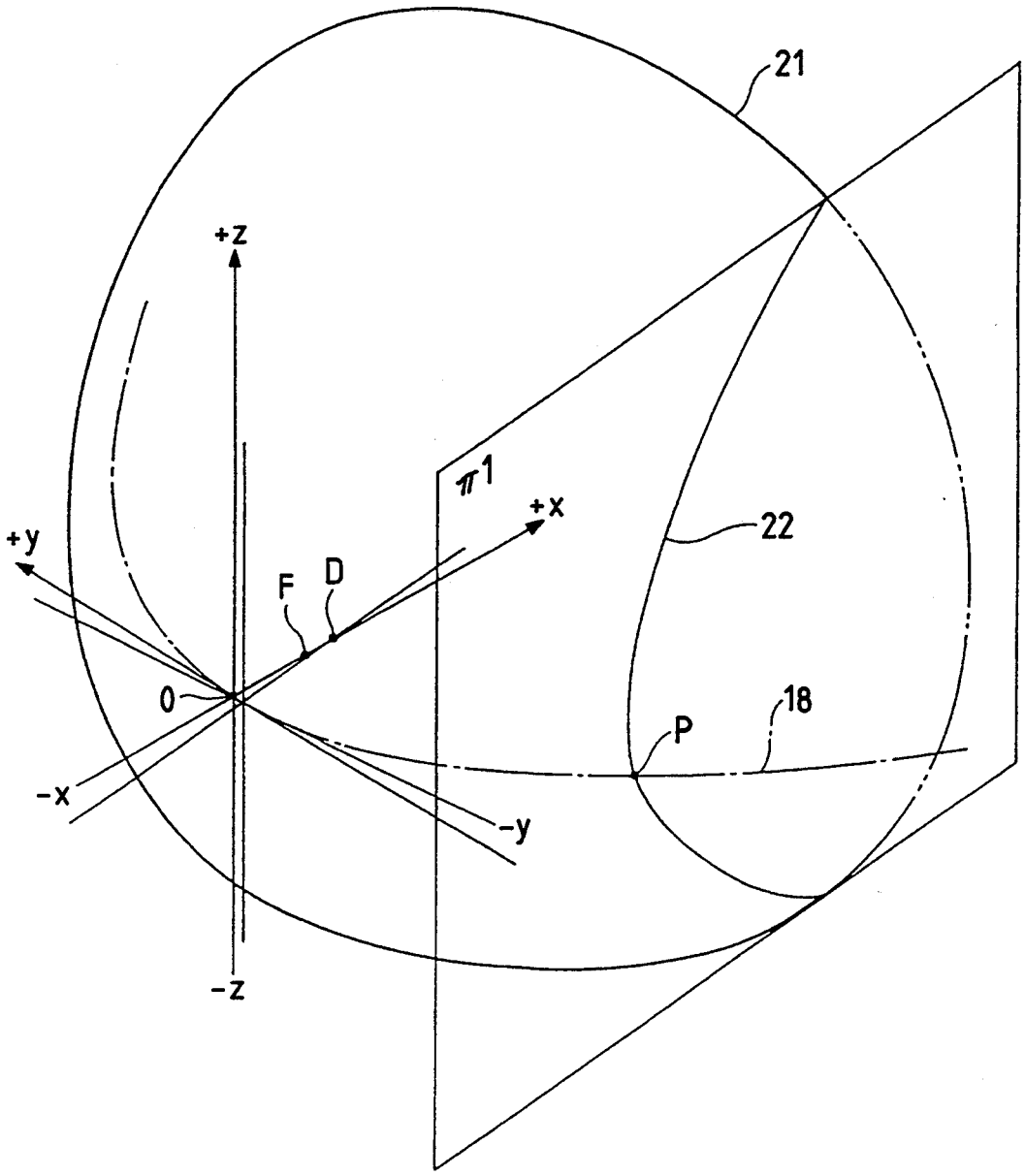
FIG. 10 is a schematic perspective view illustrative of the reflecting surface of the invention.

FIGS. 9 and 10 show this situation in more detail.

A point P in the figures designates an arbitrary point on a parabola 18 (i.e., a boundary line between the reflecting sectors 3 and 4) within the x-y plane. If a light ray emitted from a point F is reflected at the point P, then a reflected light ray 19 advances in parallel with the x-axis (the advancing direction is indicated by a vectored PS).

A light ray 20, emitted from a point D and then reflected at the point P, is at a smaller reflection angle than that of the light ray 19, based on the law of reflection. Light ray 20 advances straightly, forming an angle ($\alpha$) with respect to the light ray 19 (the advancing direction is indicated by a vector PM).

Now, assume a virtual paraboloid of revolution 21 (indicated by a two-dot chain line) that has the point D as its focus and an optical axis parallel with the light ray vector PM) and that passes through the point P. A cross sectional line (i.e., an intersection line 22) is obtained when the virtual paraboloid 21 is cut by a plane $\pi 1$ that includes the light ray vector PM) and is in parallel with the z-axis. It goes without saying that such a cross sectional line is parabolic. Further, the assumption of such a line is appropriate because the relationship that the light rays reflected at arbitrary points on the parabola 22 after being emitted from the point D travel substantially in parallel with one another should be satisfied as indicated in FIG. 8. This also holds true for another point $P^0$ on the parabola 18. In this case, an intersection line of a virtual paraboloid 21' and a virtual plane forms a part of the reflecting surface that is being sought. The virtual paraboloid 21' has the point D as its focus and an optical axis parallel with the light ray reflected at the point $P^0$ after being emitted from the point D. The virtual plane is parallel with the optical axis of the virtual paraboloid 21', passes through the point $P^0$, and is parallel with the z-axis. (It should be noted here, however, that an angle $\alpha'$, formed between the light ray reflected at the point $P^0$ after being emitted from the point F and the light ray reflected at the point $P^0$ after being emitted from the point D, is different from the angle $\alpha$ in the above case).

Accordingly, a collection of intersecting lines, each being an intersecting line of a virtual paraboloid corresponding to an arbitrary point P on the parabola 18 and a virtual plane which is parallel with the optical axis of that virtual paraboloid, passes through the point P, and is parallel with the z-axis, forms a reflecting surface that is being sought.

The formula of the reflecting surface in the reflecting sector 4 (i.e., $x > 0$, $z < 0$) will be obtained based on a parametric representation using parameters shown in Table 1.

TABLE 1

| Parameter | Definition of Parameters<br>Definition |
|---|---|
| f | Focal length of parabola 18 ($\overline{OF}$) |
| d | Distance between point F and point D ($\overline{FD}$) |
| q | Specifies a point on parabola 18 |
| h | Height in z-direction with surface $z = 0$ as reference |
| Q | $= (f^2 + q^2)/f$ |

Figure 11:
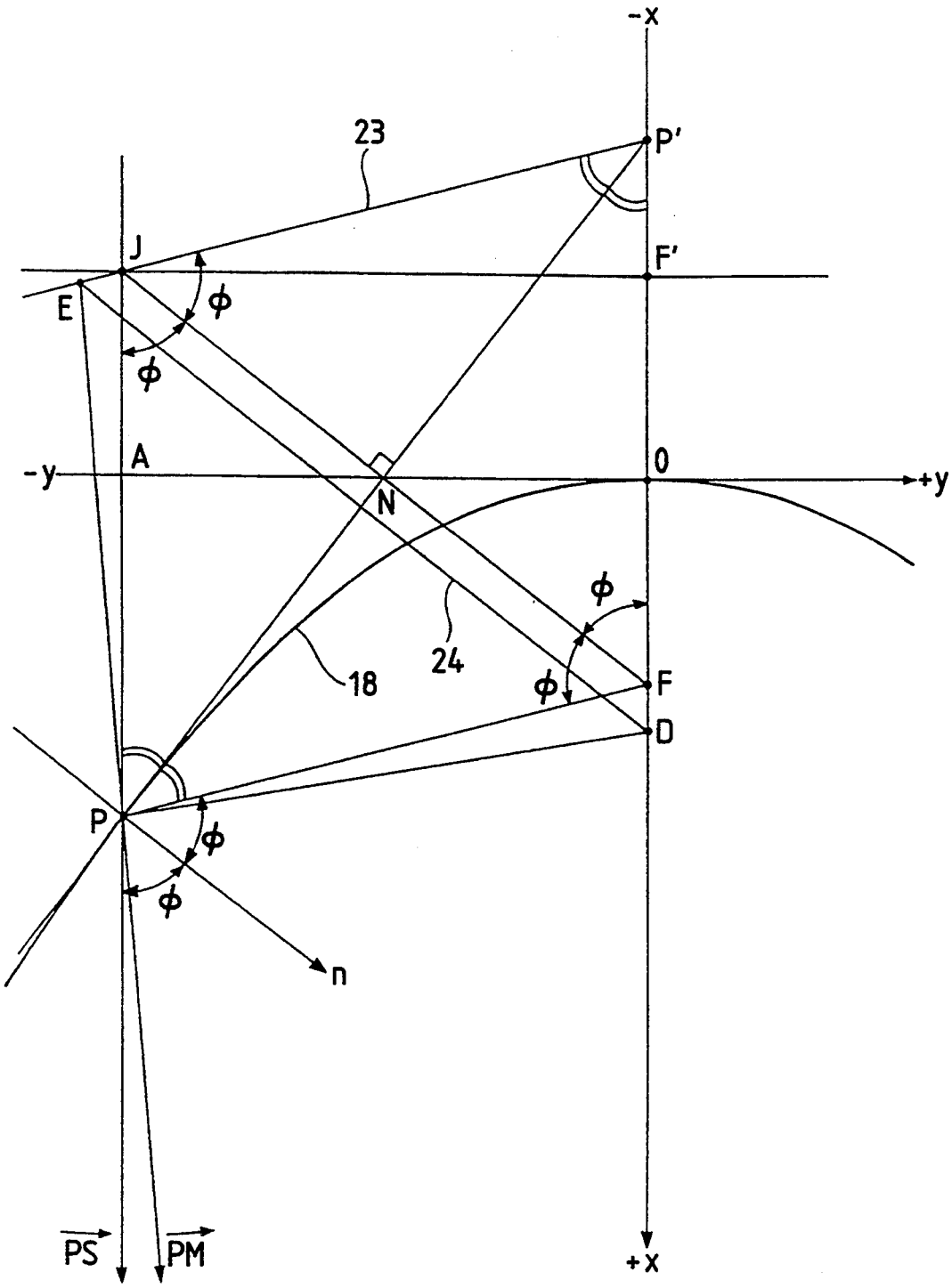
FIG. 11 is a diagram in an x-y plane that is necessary in obtaining equations of the reflecting surface of the invention.

FIG. 11 shows an x-y plane (i.e., $z=0$). An arbitrary point P on the parabola 18 can be expressed as $P(q^2/f, -2q, 0)$ using a parameter q. (An equation of the parabola, $y^2=4$ fx can be obtained by eliminating q from equations $x=q^2/f$ and $y=-2q$). The definition of the respective coordinates appearing in FIGS. 11–13 is shown in Table 2.

TABLE 2

| Point | Definition of Respective Points<br>Coordinates<br>x | y | z | Definition |
|---|---|---|---|---|
| F | f | 0 | 0 | Focus of parabola 18 |
| P | $q^2/f$ | $-2q$ | 0 | Arbitrary point on parabola 18 |
| D | f + d | 0 | 0 | Point offset by d from point F in positive direction of x-axis |
| F' | $-f$ | 0 | 0 | Intersection of directrix of parabola 18 and y-axis |
| A | 0 | $-2q$ | 0 | Foot of perpendicular drawn from point P to y-axis |
| J | $-f$ | $-2q$ | 0 | Intersection of straight line passing through points P and A and parabola 18 |
| N | 0 | $-q$ | 0 | Midpoint of line segment JF |
| P' | $-q^2/f$ | $-2q$ | 0 | Intersection of straight line passing through points P and N and x-axis |
| E | $x_e$ | $y_e$ | $z_e$ | Point symmetrical with point D with respect to straight line line PN |
| B | $X_b$ | $Y_b$ | $Z_b$ | Point to be obtained intersecting line 22 |
| H | $x_e$ | $y_e$ | $z_e + h$ | Point offset by h in direction parallel with z-axis from point E |
| $F_c$ | $x_c$ | $y_c$ | $z_c$ | Midpoint of line segment HD |
| $U_p$ | $q^2/f$ | $-2q$ | h | Point offset by h in direction parallel to z-axis from point P |

Figure 12:
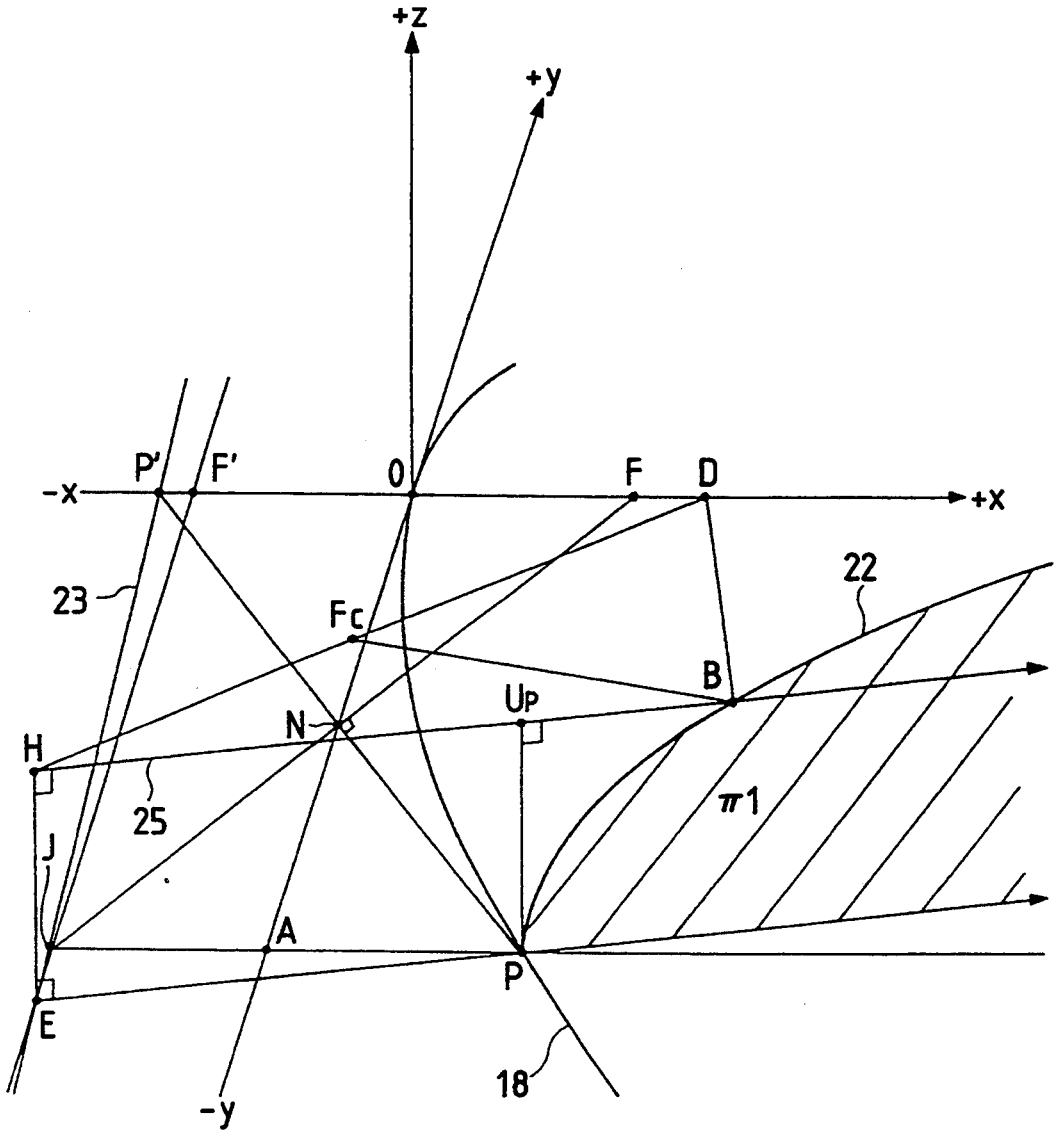
FIG. 12 is a schematic perspective view necessary in obtaining the equations of the reflecting surface of the invention.
Figure 13:
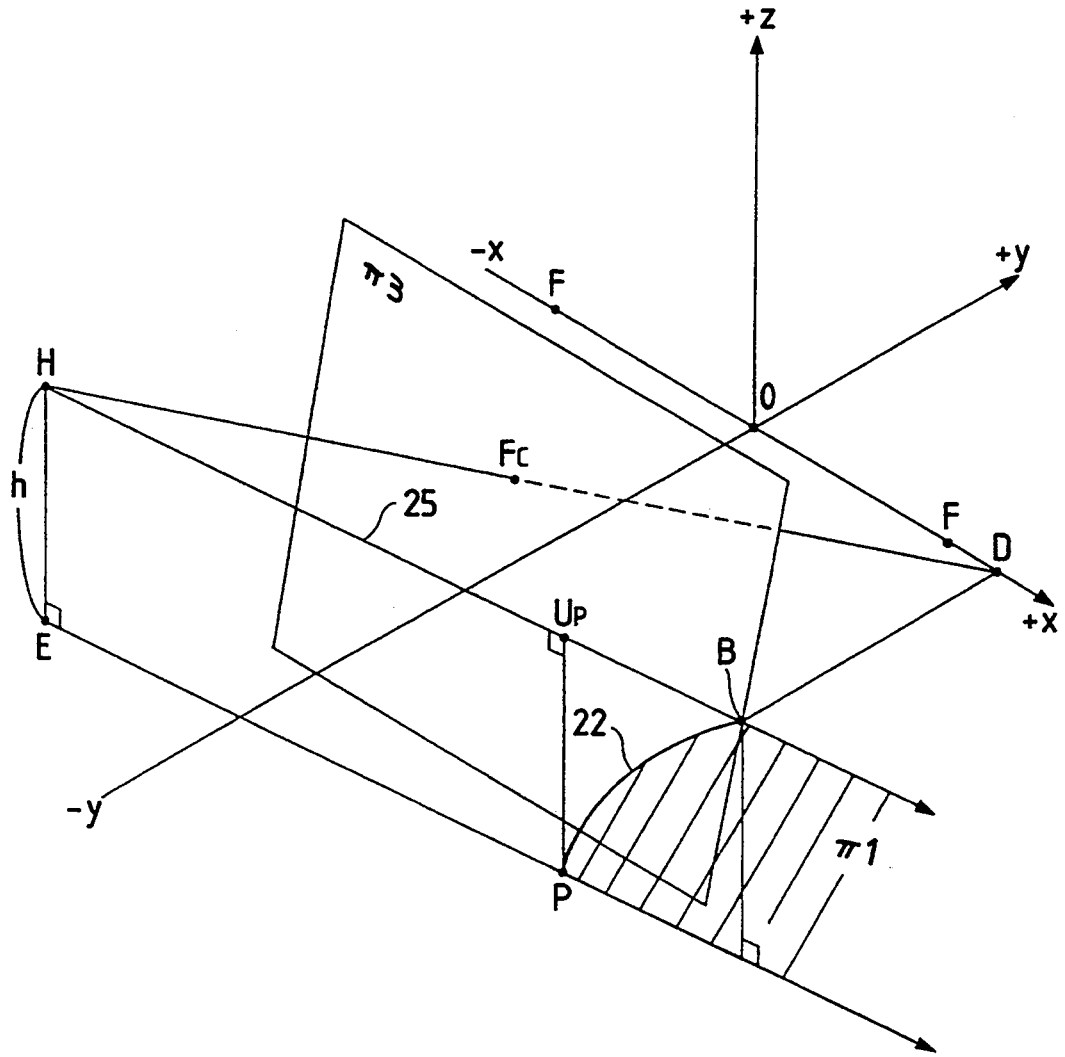
FIG. 13 is a schematic perspective view showing the geometric relationship among an isosceles triangle ΔHBD and planes $\pi 3$ and $\pi 1$.

FIGS. 12 and 13 are schematic perspective views illustrating a geometric relationship to be used in obtaining the expression of the reflecting surface that is being sought. The definition of lines and planes appearing in FIGS. 12 and 13 is shown in Table 3.

TABLE 3

| Line/Plane | Definitions of Lines and Planes<br>Definition |
|---|---|
| Parabola 18 | Reference parabola in x-y plane |
| Straight line F'J | Directrix of parabola 18 |
| Straight line 23 | Straight line passing through points J and P' |
| Straight line 24 | Straight line passing through point D and being parallel with vector NF |
| Plane $\pi 1$ | Plane containing light ray vector PM and being parallel to z-axis |
| Parabola 22 | Intersecting line of paraboloid of revolution having optical axis that is parallel with vector EP, passing through point P, and having point D as focus, and plane $\pi 1$ |
| Straight line 25 | Straight line passing through points H and B |
| Plane $\pi 3$ | Plane passing through point $F_c$ and |

TABLE 3-continued

| Line/Plane | Definitions of Lines and Planes<br>Definition |
|---|---|
| | being perpendicular to vector HD |

To derive a formula of the reflecting surface, a vector EP that is in the same direction as the light ray vector PM is first found, and coordinates of a point B on the intersecting line of the above-described virtual paraboloid 21 for the point P and the plane $\pi$1 are expressed in such a case that the z-axis is expressed using a parameter h.

Now, in FIG. 11, a reflection angle of a light ray emitted from the point F and then reflected at the point P is written as $\phi$ (if the normal direction at the point P is represented by n, the reflection angle $\phi$ is equal to $\angle$FPn). Also, let us consider such geometric characteristics of a parabola that: a straight line JP is parallel with the x-axis; a point N is the midpoint of a line segment JF; a straight line F'J is the directrix of the parabola; and a line segment FP and a line segment JP are equal in length. Then, it is understood that a rhombus PFP'J is divided into four congruent triangles $\Delta$NFP, $\Delta$NJP, $\Delta$NJP', $\Delta$NFP' by the line segment FJ and a line segment PP'.

The vector EP that is in the same direction as the light ray vector PM can be obtained by determining a point E that is symmetrical to the point D with respect to a tangent PN (or PP') of the paraboloid 18 at the point P.

Coordinates of the point E can be obtained as those of an intersection of a straight line 23 passing through the points J and P' and a straight line 24 passing through the point D and being parallel with a vector NF. The formula of the straight line 23 is:

$$\frac{x+f}{f-q^2/f}=\frac{y+2q}{2q} \qquad \text{[Formula 1]}$$

The formula of the straight line 24 is:

$$\frac{x-(f+d)}{f}=\frac{y}{q} \qquad \text{[Formula 2]}$$

Hence, the x- and y-coordinates of the point E can be obtained by solving simultaneous equations of Formula 1 and Formula 2 as Formula 3. (It is apparent that z=0 because the point E is in the x-y plane.)

$$x_e=-f-\left(\frac{f^2-q^2}{f^2+q^2}\right)d \qquad \text{[Formula 3]}$$

$$y_e=-2q\left(1+\frac{fd}{f^2+q^2}\right)$$

$$z_e=0$$

Thus, the vector EP can be obtained from the coordinates of the points P and E. The vector EP is expressed as Formula 4 in the form of a column vector so as to be distinguished from the coordinates of a point.

$$EP=\begin{pmatrix}\frac{f^2+q^2}{f}+\left(\frac{f^2-q^2}{f^2+q^2}\right)d\\ 2q\left(\frac{fd}{f^2+q^2}\right)\\ 0\end{pmatrix} \qquad \text{[Formula 4]}$$

Coordinates of the point B on the intersection line 22 of the virtual paraboloid 21 and the plane $\pi$1, the virtual paraboloid 21 having the optical axis parallel with the vector EP, will be obtained next. Here, coordinates of the point B is determined without obtaining an expression of the virtual paraboloid 21 (the virtual paraboloid is a surface to be utilized only in the analytical process there is no purpose in expressing it by a specific formula).

As shown in FIG. 12, a point H is offset from the point E by h in the direction parallel with the z-axis, and a straight line 25 passes through the point H and the point B ($z_b$ =h) on the parabola 22. The parabola 22 is an intersecting line obtained when the virtual paraboloid 21 is cut by the plane $\pi$1. Thus, the distance from the point B to the point H that is the foot of a perpendicular to a directrix EH is equal to the distance from the point B to the focus D of the virtual paraboloid 21 (the geometrical characteristic of a paraboloid of revolution).

That is, since the point B that is to be obtained is the vertex of an isosceles triangle HBD in which line segments HB and BD are equal in length, the coordinates of the point B can be determined by calculating, as shown in FIG. 13, coordinates of an intersection of a plane $\pi$3 and the straight line 25, the plane $\pi$3 passing through the midpoint $F_c$ of the line segment HB and being perpendicular to a vector HD.

Since the point $F_c$ is the midpoint of the line segment HD, its coordinates in question can be calculated immediately from Formula 5.

$$x_c=\frac{q^2d}{f^2+q^2} \qquad \text{[Formula 5]}$$

$$y_c=-q\left(1+\frac{fd}{f^2+q^2}\right)$$

$$z_c=\frac{h}{2}$$

The vector HD can then be calculated from Formula 6 based on the coordinates of the points H and D.

$$HD=\begin{pmatrix}2f\left(1+\frac{fd}{f^2+q^2}\right)\\ 2q\left(1+\frac{fd}{f^2+q^2}\right)\\ -h\end{pmatrix} \qquad \text{[Formula 6]}$$

Hence, the plane $\pi$3 is expressed by Formula 7, which is an equation expressing a plane that passes through the point $F_c$ and has the vector HD as its normal vector.

$$2f\left(1+\frac{fd}{f^2+q^2}\right)\left(x-\frac{q^2d}{f^2+q^2}\right)+ \qquad \text{[Formula 7]}$$

-continued $$2q\left(1+\frac{fd}{f^2+q^2}\right)\left[y+q\left(1+\frac{fd}{f^2+q^2}\right)\right]-h\left(z-\frac{h}{z}\right)=0$$

The straight line 25 is expressed by Formula 8, which includes an equation expressing a straight line that passes through a point $U_p$ distant from the point P by h in a direction parallel with the z-axis and has the vector EP as its direction vector.

$$\frac{x-q^2/f}{\frac{f^2+q^2}{f}+\left(\frac{f^2-q^2}{f^2+q^2}\right)d}=\frac{y+2q}{2q\left(\frac{fd}{f^2+q^2}\right)} \quad \text{[Formula 8]}$$

$$z=h$$

Thus, the coordinates of the point B is finally obtained from Formula 9 by solving simultaneous equations of Formula 7 and Formula 8 for x and y, and performing a replacement by a parameter Q.

[Formula 9]

$$x_b=\frac{(Q-f)\left[1+\frac{2d(Q-f)}{Q^2+(2f-Q)d}\right]+\frac{h^2}{4f(1+d/Q)}}{1+\frac{2d(Q-f)}{Q^2+(2f-Q)d}}$$

$$y_b=2q\left[\frac{d(x-Q+f)}{Q^2+(2f-Q)d}-1\right]$$

$$z_b=h$$

$$\text{where } Q=\frac{f^2+q^2}{f}$$

This Formula 9 includes the desired equations of the reflecting surface. In these equations, if $d=0$, $x_b=q^2/f+h^2/4f$, $Y_b=-2q$ can be obtained immediately. Then, by replacing h by z, $x_b$ by x, and $Y_b$ by y and by eliminating the parameter q, an equation of a paraboloid of revolution can be obtained.

[Formula 10]

$$y^2+Z^2=4fx$$

It is understood therefore that Formula 9 includes a paraboloid of revolution as a special case where $d=0$. Thus, it is possible to provide a single expression for both a paraboloid of revolution forming the reflecting sector 3 and a reflecting surface forming the reflecting sector 4. The configuration of the reflecting sector 3 (halved paraboloid of revolution) can be expressed if $h>0$ and $d=0$ in Formula 9, while the configuration of the reflecting sector 4 can be expressed if $h<0$ and $d\neq 0$. Satisfaction of the aforesaid continuity condition a) can easily be verified from the fact that Formula 9 coincides with the equation of the parabola 18 if h is set equal to 0 in Formula 9.

Figure 14:
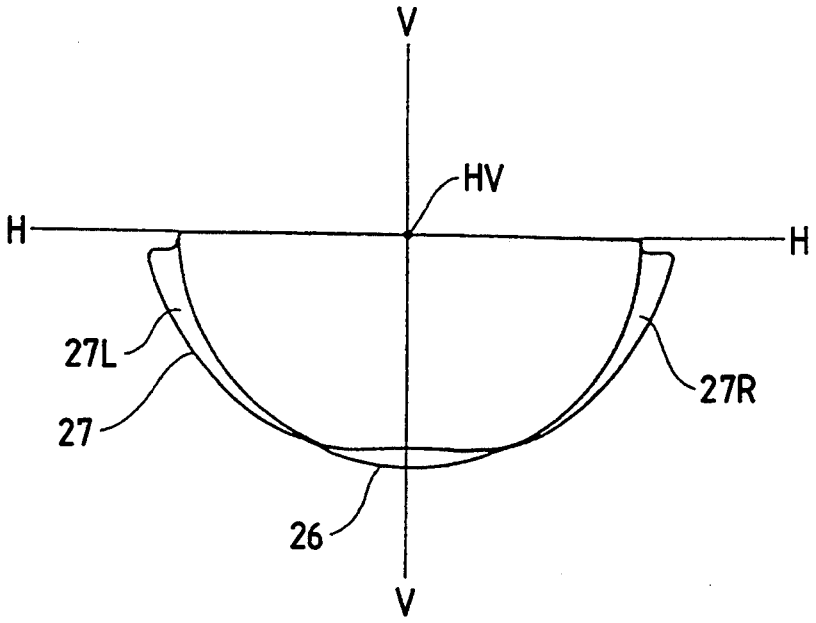
FIG. 14 is a diagram showing a pattern image obtained by a reflecting surface expressed by Formula 9.
Figure 15:
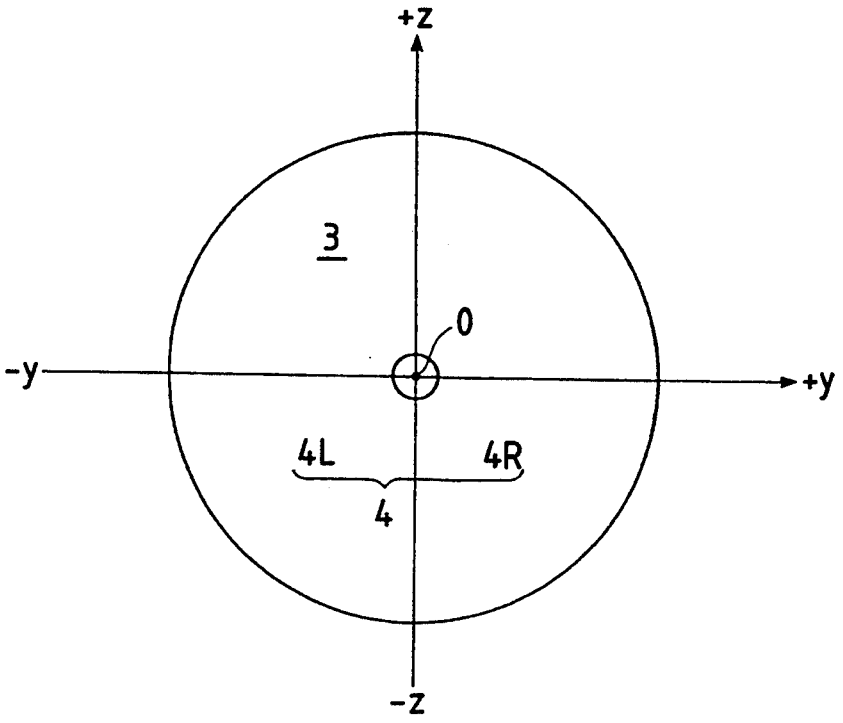
FIG. 15 is a front view of a reflecting surface illustrative of reflecting sectors.

FIG. 14 shows a light-distribution pattern obtained when the filament 5 is arranged between the points F and D such that its center is slightly offset in the positive direction of the z-axis. In FIG. 14, a semicircular pattern 26 located below the horizontal line H—H is due to the reflecting sector 3, while a bowl-like pattern 27 is due to the reflecting sector 4. For the latter pattern 27, if the reflecting sector 4 is divided into two portions where $y>0$ and $y<0$, respectively as shown in FIG. 15, it is understood that the pattern 27 consists of a right pattern 27R by the reflecting sector 4R ($y>0$) and a left pattern 27L by the reflecting sector 4L ($y<0$), and that the patterns 27R and 27L are symmetrical with respect to the vertical line V—V.

By the way, the formation of a cutline has not been considered in the above discussion. Specific design guidelines for a reflecting surface to provide a cutline specific to a low beam will now be discussed below.

Figure 16:
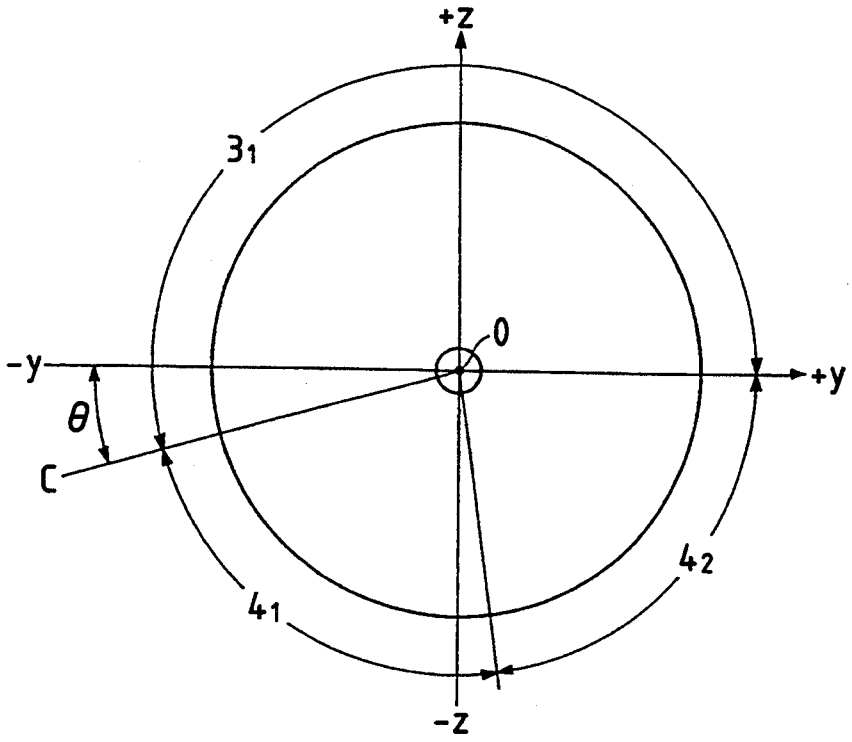
FIG. 16 is a front view showing the construction of a reflecting surface that is easily obtained in the course of conceiving a reflecting surface capable of forming a cutline.

It may first be conceived to divide the reflecting surface 1 into three sectors as shown in FIG. 16. That is, the reflecting surface 1 is divided into three sectors $3_1$, $4_1$ and $4_2$ employing an angle-definition method in which an angle $\beta$ around the x-axis is measured from the +y-axis (original line) and increases counterclockwise when viewed from the positive side of the x-axis.

When the cutline angle $\theta$ is 15°, the sector $3_1$ is a paraboloid of revolution having a focus F and occupying a range $\beta$ of 0° to 195°. The sector $4_2$ occupying a range $\beta$ of 195° to 277.5° has a configuration obtained by rotating a portion of the reflecting sector 4L which is in a range of $\beta$ of 180° to 262.5° counterclockwise by 15°. The sector $4_2$ occupying a range $\beta$ of 277.5° to 360° has a configuration obtained by excluding a portion of the reflecting sector 4R which is in a range of $\beta$ of 270° to 277.5°.

Figure 17:
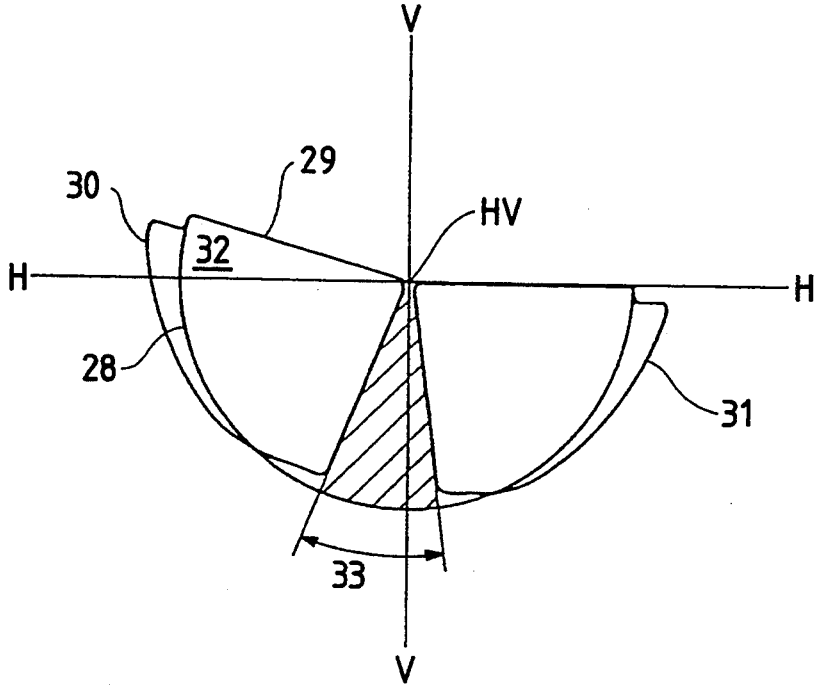
FIG. 17 is a diagram showing a pattern image obtained by the reflecting surface shown in FIG. 16.

FIG. 17 schematically shows a light-distribution pattern by the aforesaid reflecting surface. The upper left edge of a pattern 28, which is due to the sector $3_1$, forms a cutline 29 having an angle of 15° with respect to the horizontal line H—H.

A pattern 30 is formed by the sector $4_1$, and its upper edge substantially coincides with the cutline. A pattern 31 is formed by the sector $4_2$, and its upper edge substantially coincides with the horizontal line H—H.

However, the above light-distribution pattern has two problems. The first problem is that a portion 32 surrounded by the cutline 29 and the horizontal line H—H is too bright compared with other portions, and the second one is that the quantity of light in a gap portion 33 (about 30° in terms of central angle; indicated by hatching in FIG. 17) between the patterns 30 and 31 is insufficient. The latter problem cannot be eliminated even by the diffusion effect in the horizontal direction of the outer lens arranged in front of the reflector, thus leaving a dark portion on a light-distribution pattern.

To overcome these problems, it is necessary to design such a reflecting sector ($\beta=195°$ to 360°) as not to cause the aforesaid inconveniences in forming a cutline.

Figure 18:
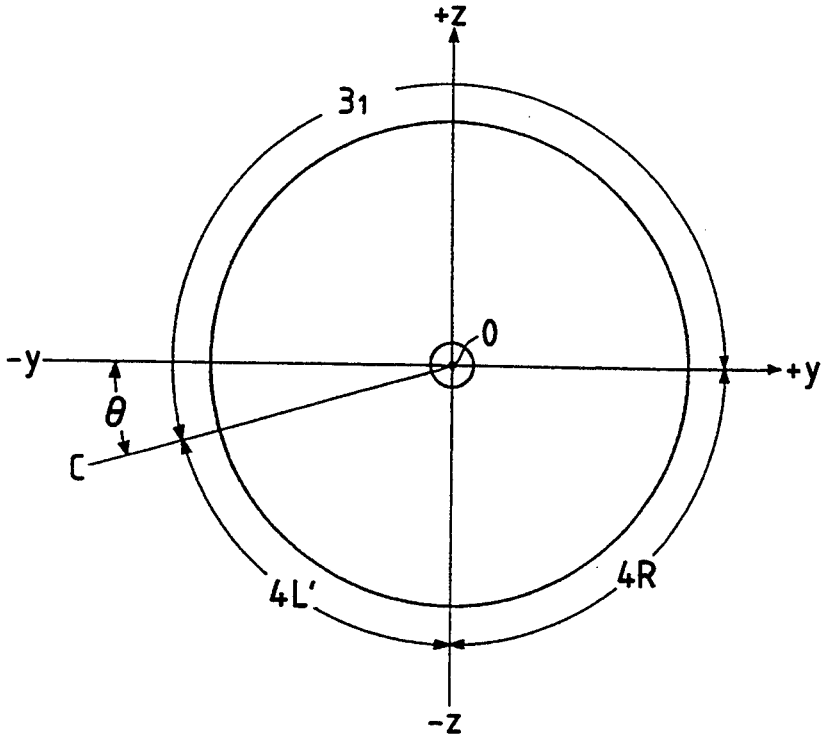
FIG. 18 is a front view showing the construction of a reflecting surface capable of obtaining a proper low beam.

FIG. 18 shows a new type of reflecting surface for obtaining a proper low beam, in which a reflecting surface 1 consists of three reflecting sectors $3_1$, 4R and 4L'. The sectors $3_1$and 4R have the same configurations as those described before, while the sector 4L' occupies a range of $\beta$ of 195° to 270° and has a configuration as discussed below.

Figure 19:
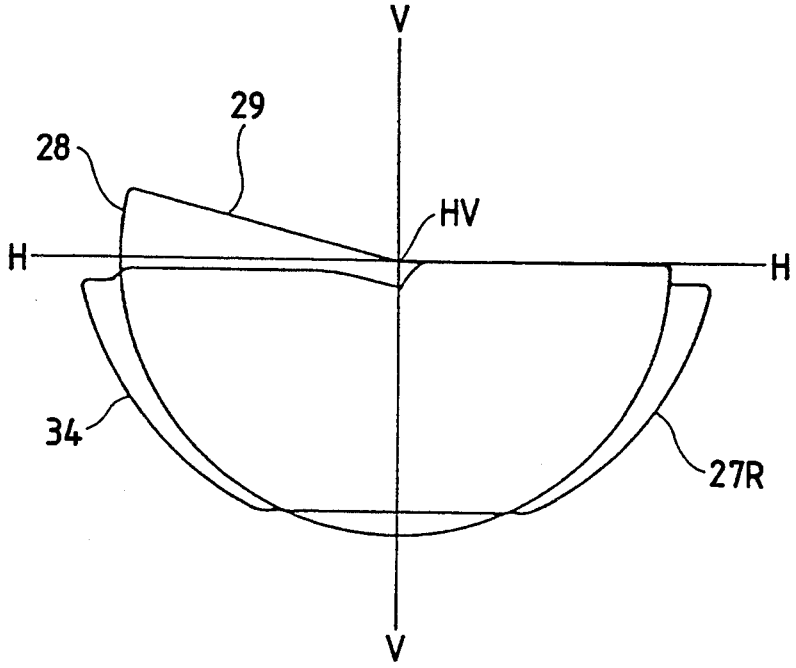
FIG. 19 is a diagram showing a pattern image obtained by the reflecting surface shown in FIG. 18.
Figure 20:
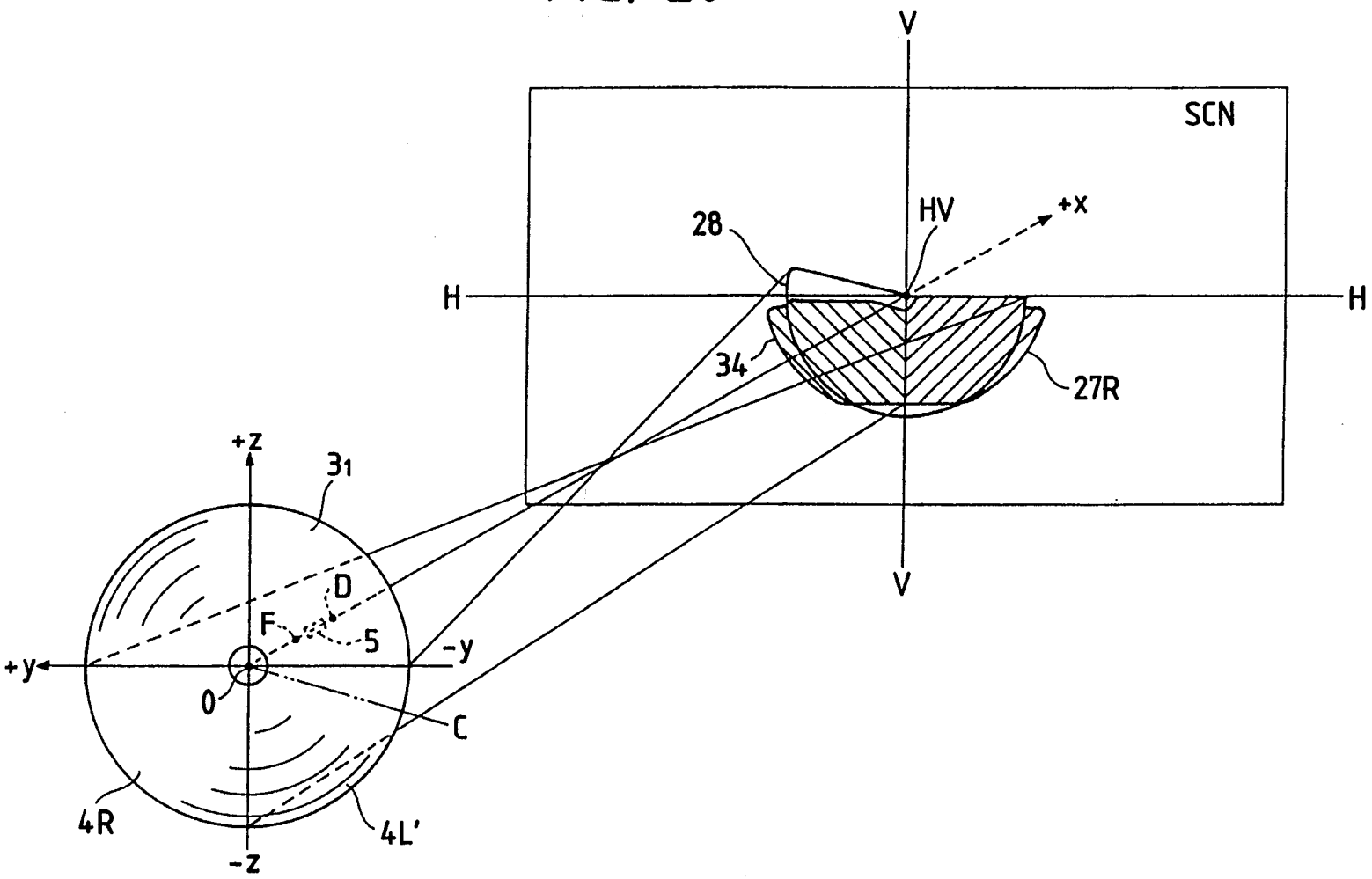
FIG. 20 is a conceptual diagram showing a correspondence between the respective sectors of the reflecting surface and the pattern image shown in FIG. 19.

FIGS. 19 and 20 schematically show a light-distribution pattern obtained by a reflecting surface having the this construction. Patterns by the sectors $3_1$ and 4R are the same as the patterns 28 and 27R, respectively. A pattern 34 by the sector 4L' is located below the horizontal line H—H and is shifted to the left of the pattern 27R, interposing the vertical line V—V. The pattern's upper edge is located only slightly below the horizontal line H—H.

Equations expressing the configuration of the reflecting sector 4L′ will be derived below, in which the following conditions are imposed.

a′) Continuity condition: The sectors $3_1$ and 4L′ are smoothly connected to each other without forming a step at their boundary.

b′) Filament image arrangement condition: Filament images from the sector 4L′ are located as near the horizontal line H—H as possible without protruding into the area above the horizontal line H—H.

c) Condition on filament image variation at boundary: A boundary line OC has a characteristic of a collection of inflection points. That is, there is a large movement of a filament image in the portions located above or below and close to the boundary line OC.

Figure 21:
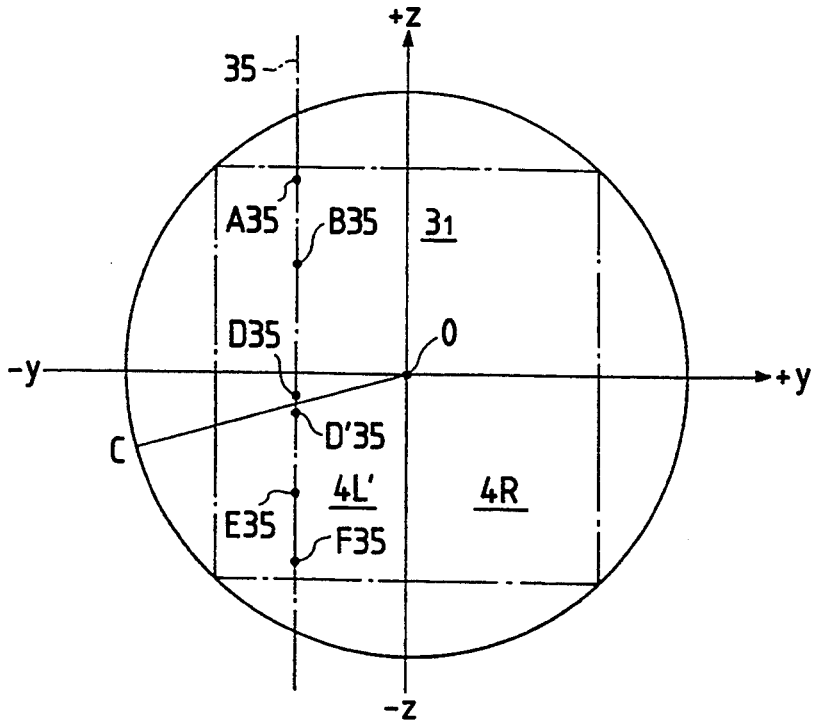
FIG. 21 is a diagram showing representative points on the reflecting surface shown in FIG. 18.
Figure 22:
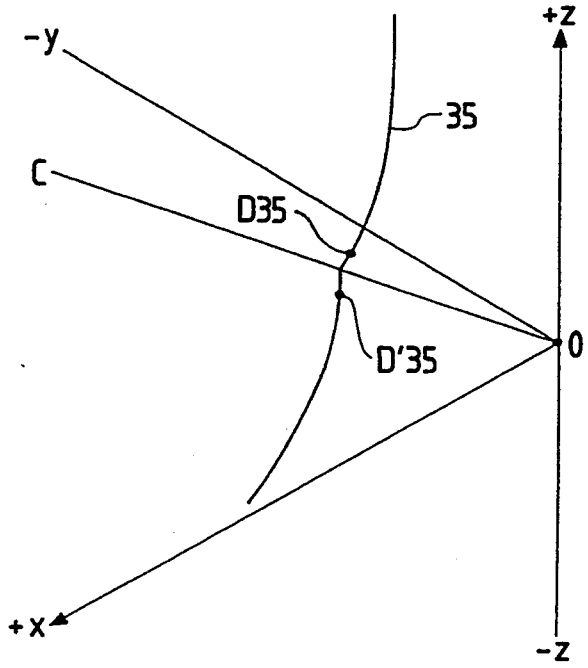
FIG. 22 is a schematic perspective view showing the representative points adjacent to a boundary line.

Since the conditions a′) and b′) are similar to the aforesaid conditions a) and b), respectively, they will not be explained below. The condition c) will be described with reference to FIGS. 21–23. FIG. 21 shows representative points on an intersection line 35 of the aforesaid reflecting surface and a plane whose y-coordinate is constant. They are designated as points A35, B35, D35, D′35, E35 and F35 from the top. The points A35, B35 and D35 belong to the sector $3_1$, while the points D′35, E35 and F35 belong to the sector 4L′. And the points D35 and D′35 are positioned immediately adjacent to each other while interposing the boundary line OC therebetween as shown in FIG. 22.

Figure 23:
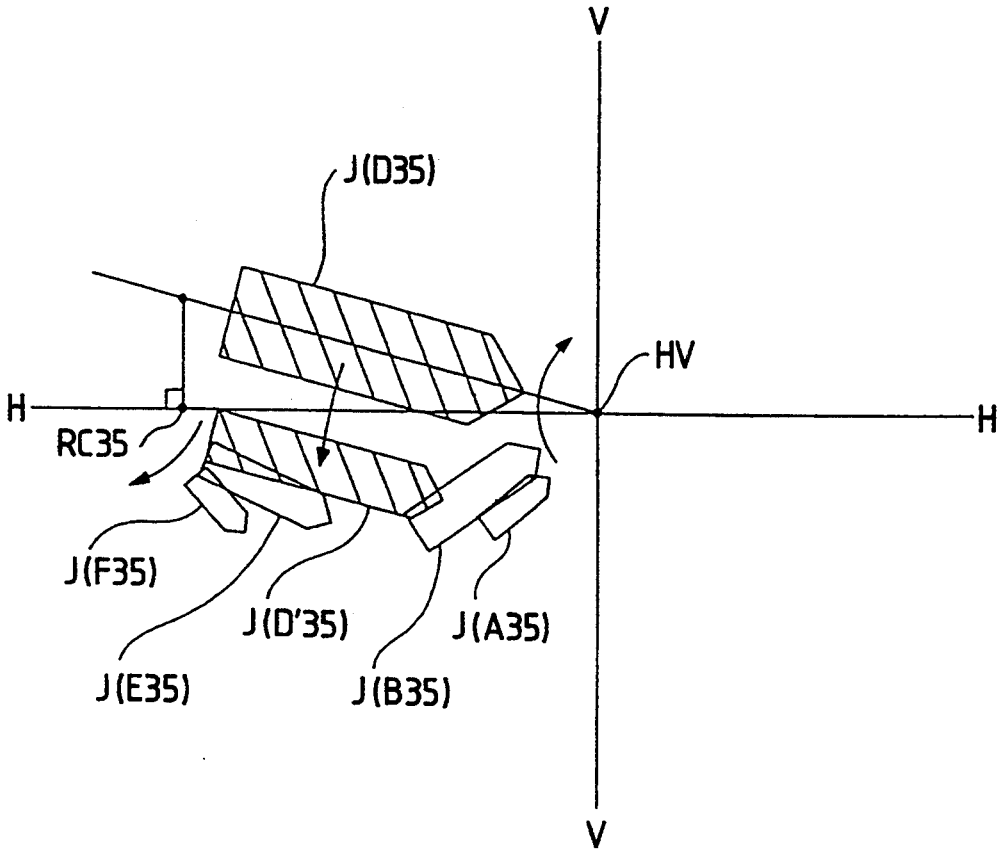
FIG. 23 is a diagram showing the arrangement of filament images by the respective representative points shown in FIG. 21.

FIG. 23 schematically shows the arrangement of filament images by these representative points, in which J(X) represents a filament image by a representative point X. As the representative point descends in the order of A35, B35 and D35, the filament image moves clockwise with the point HV as its center of rotation, and the filament image J(D35) partially forms a cutline 29. And when the representative point moves to the point D′35 passing through the boundary line OC, the filament image J(D′35) is located immediately below the horizontal line H—H, sharply falling while keeping a substantially parallel relationship with the filament image J(D35). Subsequently, the filament image rotates about a point RC35 on the horizontal line H—H from J(E35) to J(F35) as the representative point moves from E35 to F35. The large movement of the filament image after passing through the border line OC causes the upper edge of the light-distribution pattern 34 to be positioned adjacent to the horizontal line H—H.

Considering the above conditions, equations expressing the reflecting surface of the sector 4L′ will be determined next.

Figure 24:
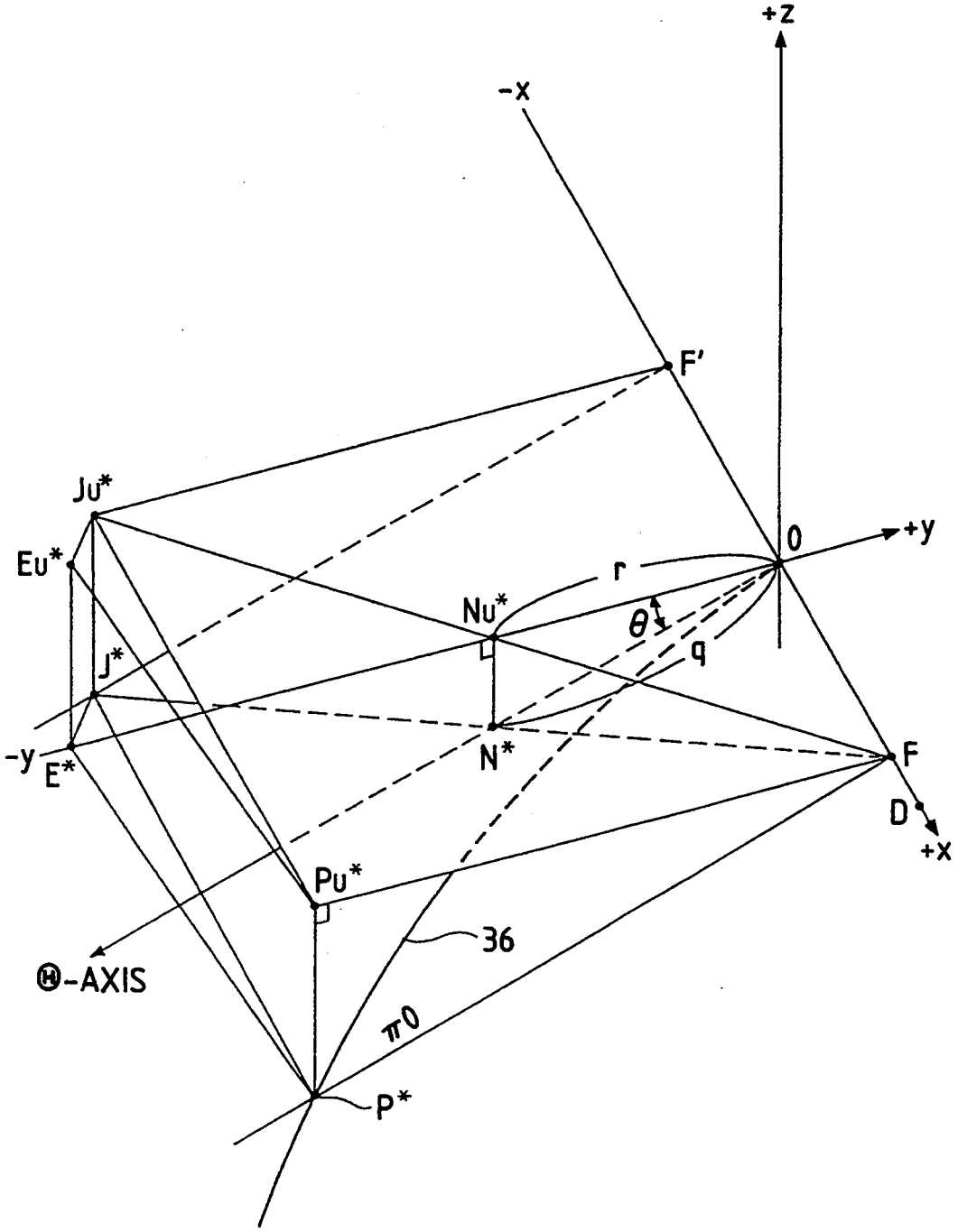
FIG. 24 is a diagram illustrative of the process of obtaining equations of a reflecting surface of the invention (mainly showing an orthogonal projection from a $\pi 0$ plane onto the horizontal plane)
Figure 25:
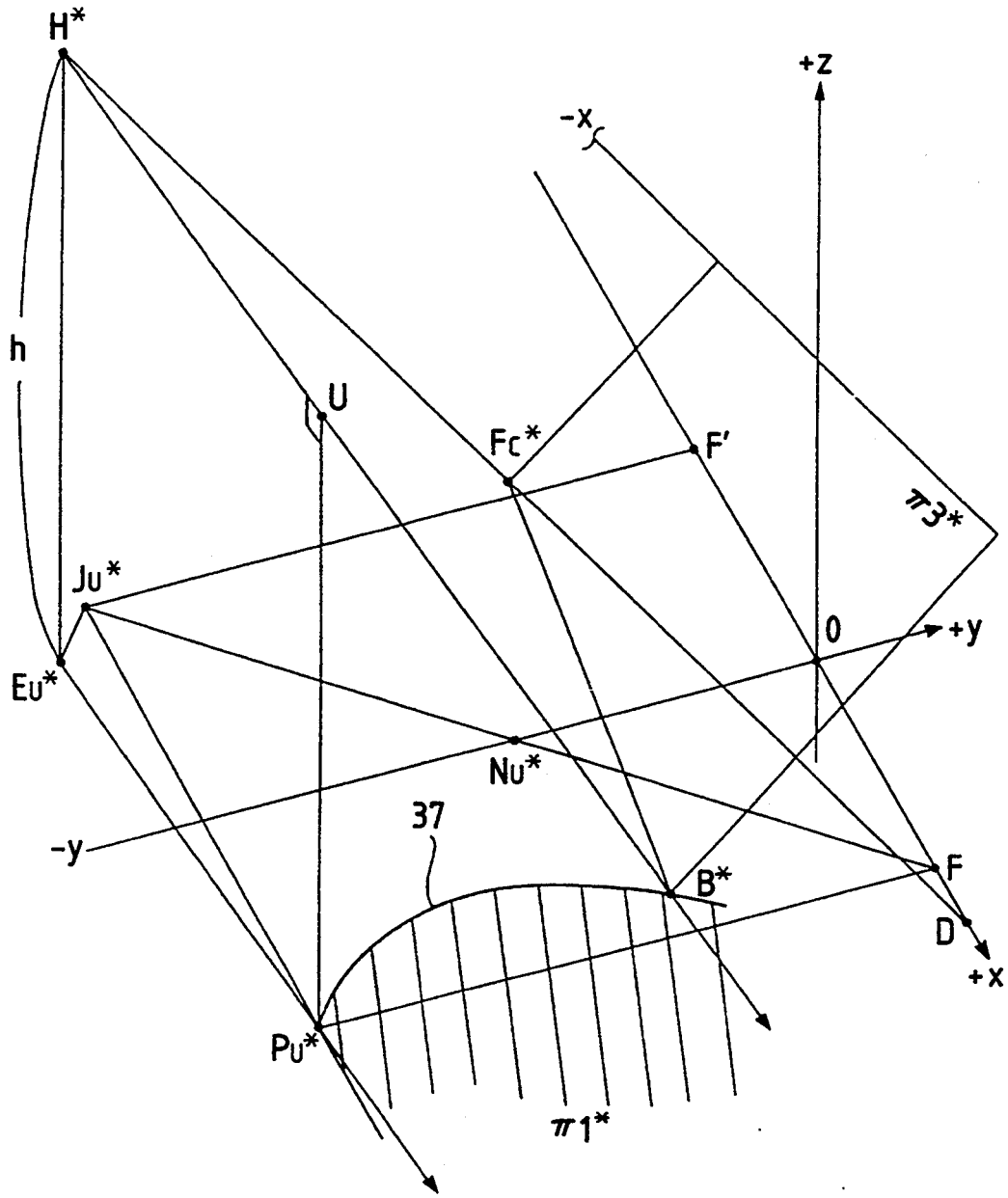
FIG. 25 is a diagram illustrative of the process of obtaining equations of a reflecting surface of the invention (mainly showing how a point B * on the reflecting surface is obtained based on an orthogonal projection onto the horizontal plane)

FIGS. 24 and 25 are diagrams illustrative of the process of obtaining equations expressing the reflecting surface. In FIGS. 24 and 25, the points F, D and F′ are defined as described in Table 2. A plane $\pi 0$ includes the x-axis and is inclined by a cutline angle $\theta$ with respect to the x-y plane. In the plane $\pi 0$, a point P* is on a parabola 36 having a point F as its focus.

FIG. 24 is different from FIG. 11 in that an axis in the plane K0 which forms an angle $\theta$ with the y-axis is selected as a $\theta$-axis, and that a distance from a point N* on the $\theta$-axis and the origin O is selected as a parameter q. That is, in FIG. 11 the parabola 18 in the x-y plane is selected as a reference, while in FIG. 24 an orthogonal projection of the parabola 36 in the plane $\pi 0$ onto the x-y plane is selected as a reference. Thus, the points in Table 2 having similar definitions except for the difference of the reference planes will hereunder be used with a superscript "*".

The definition of the respective points is shown in Table 4.

TABLE 4

Definition of Respective Points

| Point | Coordinates x | y | z | Definition |
|---|---|---|---|---|
| N* | 0 | $-q\cos\theta$ | $-q\cos\theta$ | Point displaced by q from origin O on $\theta$ axis |
| $N_u$* | 0 | −qcoso | 0 | Foot of perpendicular drawn to y-axis from point N |
| P* | $q^2/f$ | $-2q\cos\theta$ | $-2q\sin\theta$ | Arbitrary point on parabola 36 |
| J* | −f | $-2q\cos\theta$ | $-2q\sin\theta$ | Point on directrix of parabola 36, satisfying FP* =J*P* |
| $J_u$* | −f | $-2q\cos\theta$ | 0 | Foot of perpendicular drawn to x-y plane from point J* |
| E* | $x_e$* | $y_e$* | $z_e$* | Point symmetrical with point D with respect to straight line P*N* |
| $E_u$* | $x_e$* | $y_e$* | 0 | Foot of perpendicular drawn to x-y plane from point E* |
| H* | $x_e$* | $y_e$* | h | Point offset by h in direction parallel with z-axis from point $E_u$* |
| $F_c$* | $x_c$* | $y_c$* | $z_c$* | Midpoint of line segment H*D |
| $P_u$* | $q^2f$ | $-2q\cos\theta$ | 0 | Foot of perpendicular drawn to x-y plane from point P* |
| U | $q^2/f$ | $-2q\cos\theta$ | h | Point offset by h in direction parallel with z-axis from point $P_u$* |
| B* | $x_b$* | $y_b$* | $z_b$* | Point to be obtained on intersecting line 37 |

Equations of the reflecting surface can be calculated in a procedure similar to that for obtaining Formula 9 based on the points obtained by orthogonally projecting the respective points in the plane $\pi 0$ onto the x-y plane. That is, coordinates of a point B* of a cross sectional line, i.e., a parabola-shaped intersecting line 37, obtained when a virtual paraboloid of revolution having a focus D, passing through a point $P_U$*, and having an optical axis parallel with a vector $E_U$* $P_U$* is cut by a plane $\pi 1$* including a vector $E_U$* $P_U$* and being parallel with the z-axis, can be calculated as an intersection between a straight line H*B* and a plane $\pi 3$* (a plane having a vector H*D as its normal vector at a point $F_C$*) using the geometric characteristics of a paraboloid of revolution.

Coordinates of a point E* that is symmetrical to a point D with respect to a straight line P*N* are obtained as shown in Formula 11, considering the following: if the distance from a point $N_U$* to the origin O is written as r, then r=q. cos $\theta$; a straight line F′J* is the directrix of the parabola 36; and a line segment FP* and a line segment J*P* are equal in length from the geometric characteristics of a parabola.

[Formula 11]

$$x_e^* = -f - \left(\frac{f^2 - q^2}{f^2 + q^2}\right)d$$

$$y_e^* = -2q\left(1 + \frac{fd}{f^2 + q^2}\right)\cos\theta$$

-continued $$z_c^* = -2q\left(1 + \frac{fd}{f^2 + q^2}\right)\sin\theta$$

Thus, coordinates of the points $E_U^*$ and $H^*$ are found, which allows coordinates of the midpoint $F_c^*$ of the line segment $H_D^*$ to be obtained as shown in Formula 12.

[Formula 12]

$$x_c^* = \frac{q^2 d}{f^2 + q^2}$$

$$y_c^* = -q\left(1 + \frac{fd}{f^2 + q^2}\right)\cos\theta$$

$$z_c^* = \frac{h}{2}$$

Since the plane $\pi 3^*$ is a plane having the vector $H^*D$ as a normal vector at the point $F_c^*$, it can be expressed as Formula 13 after rearrangement using a parameter Q.

[Formula 13]

$$2f\left(1 + \frac{d}{Q}\right)\cdot x + 2q\left(1 + \frac{d}{Q}\right)\cos\theta \cdot y - h \cdot z =$$

$$2f\left(1 + \frac{d}{Q}\right)\left(1 - \frac{f}{Q}\right)d - 2q^2\left(1 + \frac{d}{Q}\right)^2 \cos^2\theta - \frac{h^2}{2}$$

Further, the straight line $H^*B^*$ is expressed by equations of a straight line (Formula 14) that has a vector $E_U^* P_U^*$ as a direction vector at the point U.

[Formula 14]

$$\frac{x - q^2/f}{\frac{f^2 + q^2}{f} + \left(\frac{f^2 - q^2}{f^2 + q^2}\right)d} = \frac{y + 2q\cos\theta}{2q\left(\frac{fd}{f^2 + q^2}\right)\cos\theta}$$

$$z = h$$

Therefore, equations of the reflecting surface are finally obtained as shown in Formula 15 by solving simultaneous equations of Formula 13 and Formula 14 (details of the calculation are omitted), and by replacing $x_b^*$, $Y_b^*$ and $Z_b^*$ by x, y and z, respectively.

[Formula15]

$$x = \frac{(Q - f)\left[\frac{d}{Q} + \cos^2\theta\left(1 - \frac{d}{Q} + \frac{2d(Q - f)}{Q^2 + (2f - Q)d}\right)\right] + \frac{h^2}{4f(1 + d/Q)}}{1 + \frac{2d(Q - f)\cos^2\theta}{Q^2 + (2f - Q)d}}$$

$$y = 2q\cos\theta\left[\frac{d(x - Q + f)}{Q^2 + (2f - Q)d} - 1\right]$$

$$z = h$$

$$\text{where } Q = \frac{f^2 + q^2}{f}$$

The equations of Formula 15 has the generality that they express the entire configuration of the reflecting surface shown in FIG. 18, as explained below. If $\theta = 0°$ is substituted into Formula 15, Formula 9 can immediately be obtained. Thus, the configuration of the sector 4R is expressed by specifying $\theta = 0°$ under the conditions that $y > 0$, $z < 0$. If $\theta = 0°$ and $d = 0$ are substituted into Formula 15, the equation in Formula 10 expressing a paraboloid of revolution can be obtained, which therefore expresses the configuration of the sector $3_1$. Further, if $d \neq 0$ and $\theta = 15°$ in Formula 15, the configuration of the sector 4L′ can be expressed. These are collectively shown in Table 5.

TABLE 5

| Constitution of Reflecting Surface | | |
|---|---|---|
| Reflecting Sector | Range ($\beta$) | Conditions for Formula 15 |
| $3_1$ | 0°–195° | $d = 0, \theta = 0°$<br>For $y > 0, z > 0$<br>For $y < 0, z > y\tan 15°$ |
| 4L′ | 195°–270° | $d \neq 0, \theta = 15°$<br>For $y < 0, z < y\tan 15°$ |
| 4R | 270°–360° | $d \neq 0, \theta = 0°$<br>$y > 0$ and $z < 0$ |

To verify that Formula 15 satisfies the continuity condition a′, it may be checked that the cross sectional configurations when $y = 0$ coincide with each other between the sectors 4L′ and 4R; that the cross sectional configurations when $z = 0$ coincide with each other between the sectors $3_1$ and 4R; and that the cross sectional configurations when cut by a plane, $z = y.\tan 15°$, coincide with each other between the sectors 4L′ and 4R. Satisfaction of the condition b′ is self-explanatory from the process of deriving the equations of the reflecting surface. Satisfaction of the condition c can be verified by checking that points on the boundary line OC are inflection points by obtaining respective differential coefficients on the boundary line OC in the sectors $3_1$and 4L′.

Figure 26:
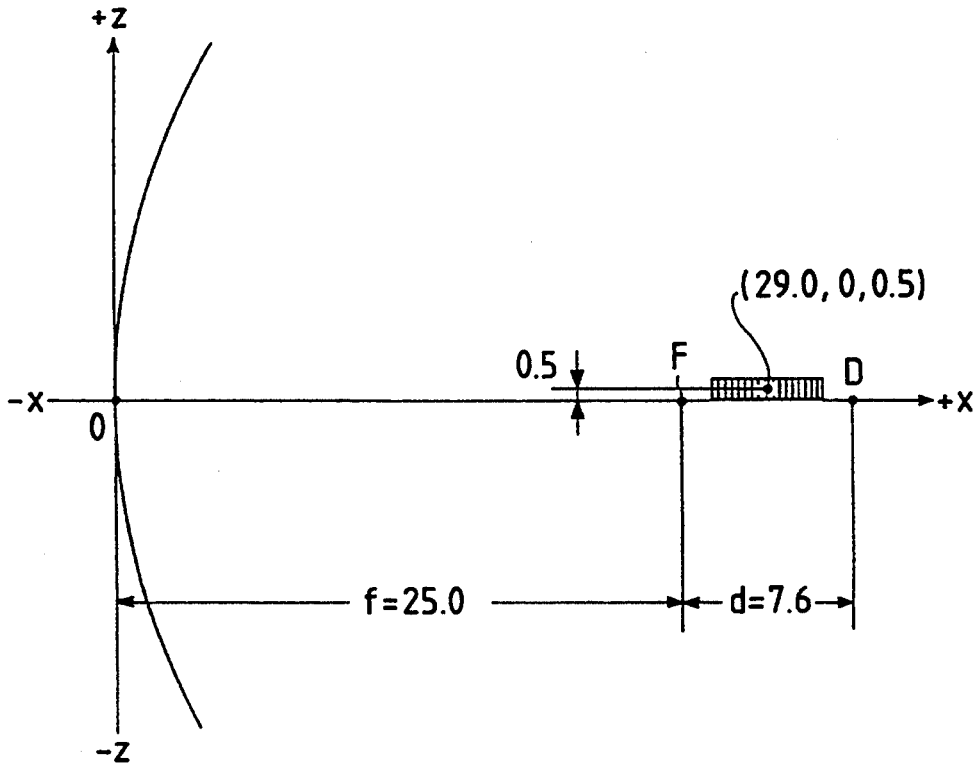
FIG. 26 is a schematic diagram showing a position of a filament.

FIGS. 28, 30, 32 and 34 show computer simulation results of the arrangement of filament images produced by the reflecting surface 1, in which it is was assumed that, as shown in FIG. 26, the focal length f is 25.0 mm; $d = 7.6$ mm; and the cutline angle $\theta$ is 15°; and the filament 5 has a cylindrical shape with the diameter being 10 mm, the length 5 mm, and the coordinates of the center (29.0, 0, 0.5).

Figure 27:
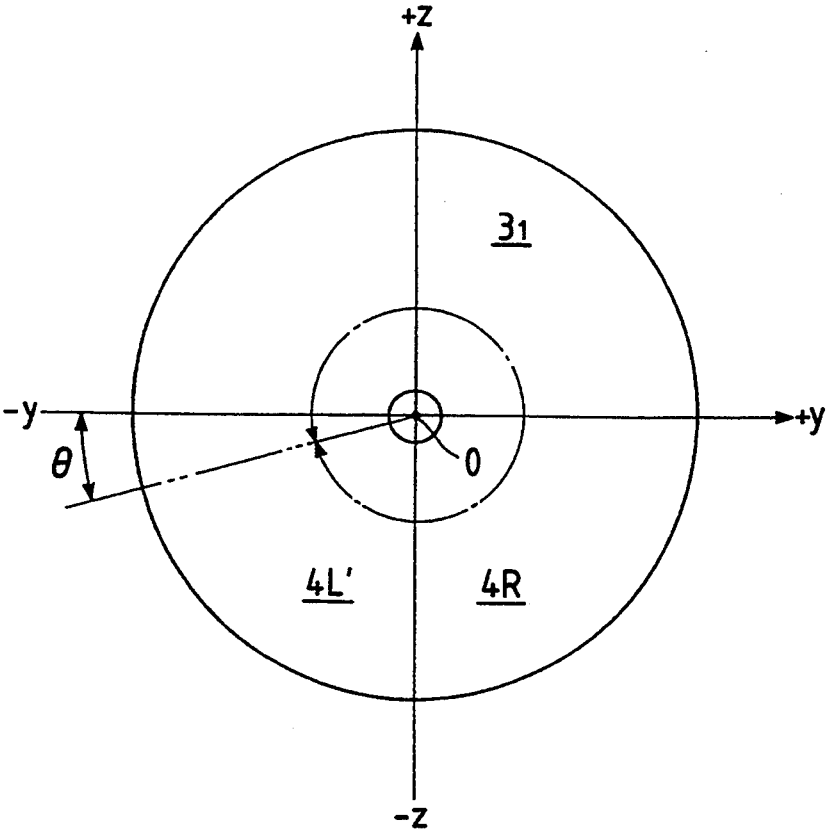
FIG. 27 is a front view showing a reflecting surface of the invention.
Figure 28:
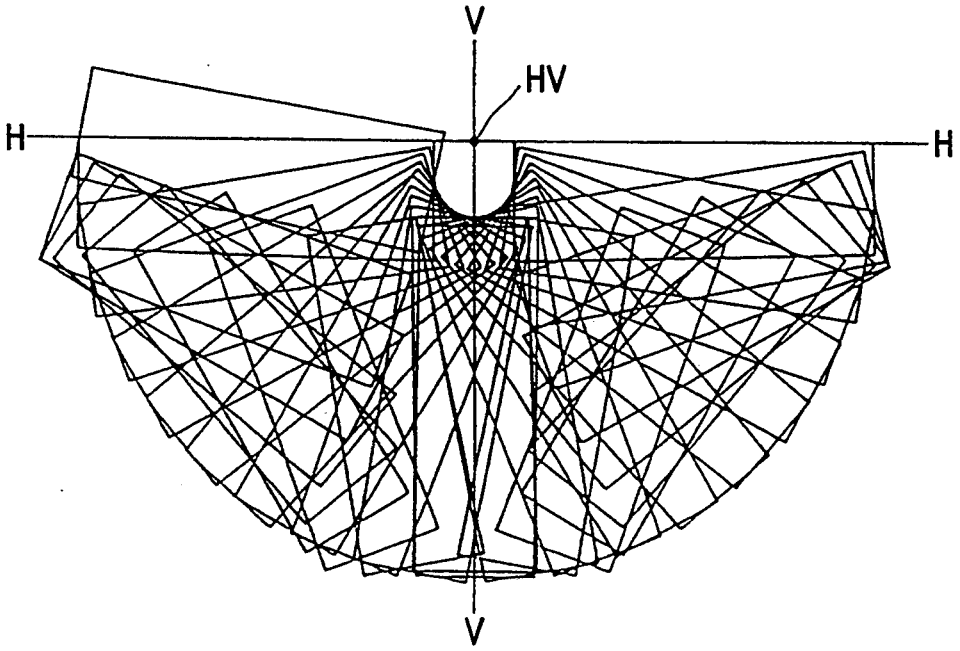
FIG. 28 is a diagram showing the arrangement of filament images by representative points having a constant distance from the origin on the reflecting surface shown in FIG. 27.

FIG. 27 is a front view of the reflecting surface 1. FIG. 28 shows the arrangement of filament images produced by representative points located on a circle indicated by the one dot chain line in FIG. 27, i.e., representative points whose distance from the origin O is constant.

Figure 29:
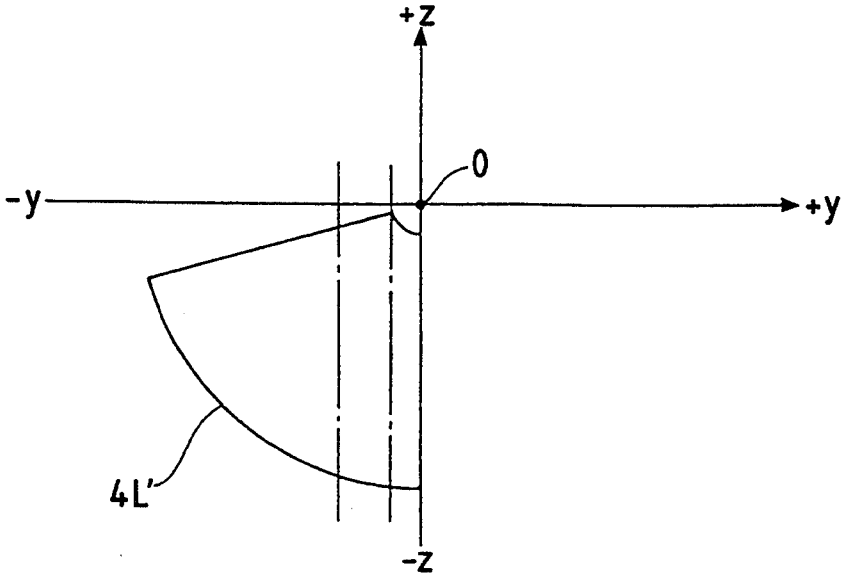
FIG. 29 is a front view showing a left reflecting sector 4L'.
Figure 30:
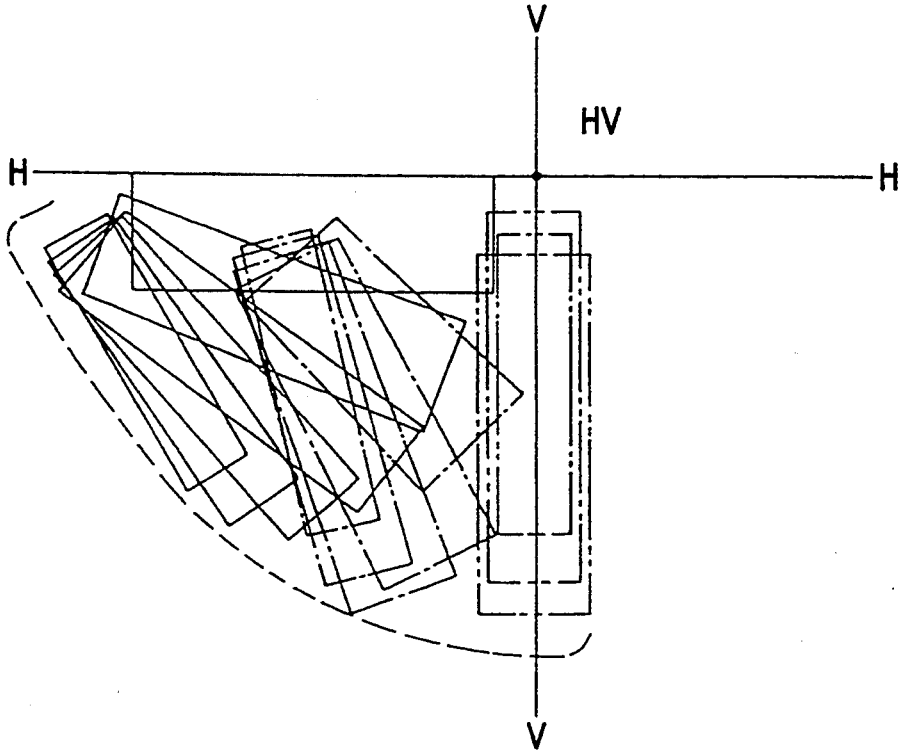
FIG. 30 is a diagram showing the arrangement of filament images by the reflecting sector 4L'.

FIG. 29 is a front view of the reflecting sector 4L′. FIG. 30 shows filament images that are produced by representative points (see FIG. 29) located on intersecting lines indicated by the one dot chain lines (y-coordinate is constant), and those on a boundary ($y = 0$). In FIG. 30, the filament images indicated by a solid line are images produced by the representative points on the intersecting line which is farther away from the origin; the filament images indicated by a one dot chain line are images produced by the representative points on the intersecting line which is closer to the origin; and the filament images indicated by a two dot chain line are images produced by the representative points on the boundary ($y = 0$). A large number of these projected images collectively form the pattern 34 shown in FIG. 19. As was intended, the upper end portions of the respective images are located immediately below the horizontal line H—H.

Figure 31:
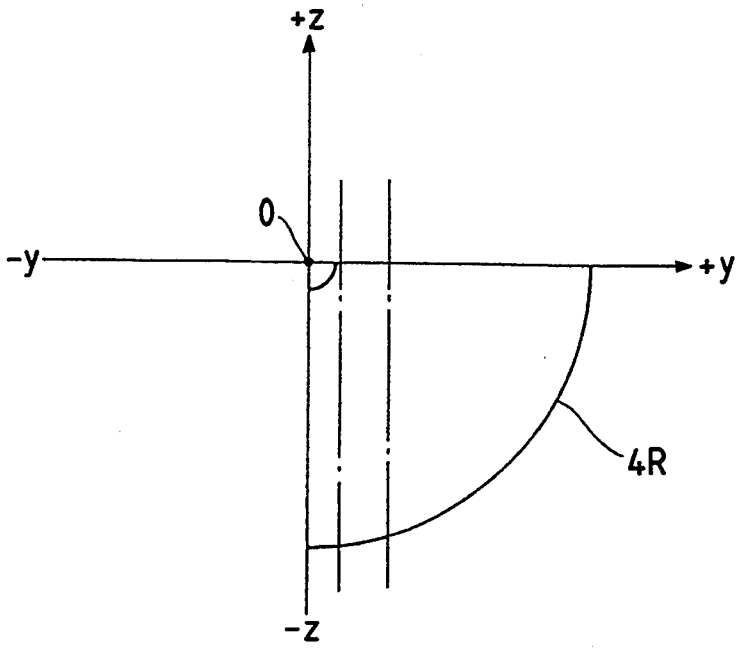
FIG. 31 is a front view showing a right reflecting sector 4R.
Figure 32:
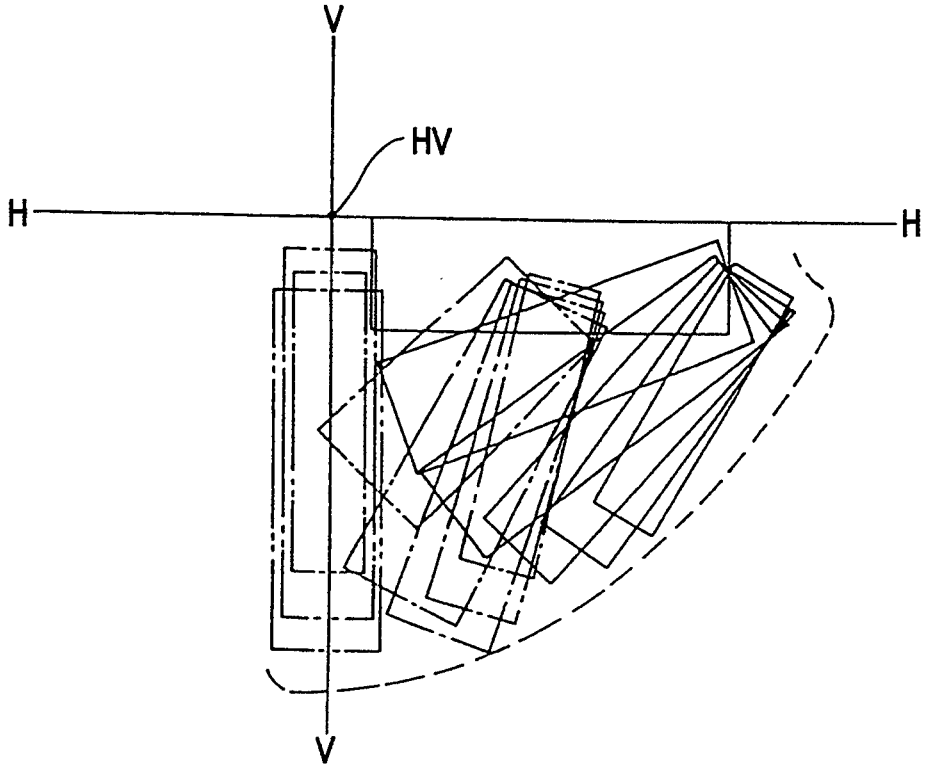
FIG. 32 is a diagram showing the arrangement of filament images by the reflecting sector 4R.

FIG. 31 is a front view of the reflecting sector 4R. FIG. 32 shows filament images produced by representative points located on the two intersecting lines indicated by the one dot chain lines and on the boundary (y=0) in FIG. 31. In FIG. 32, filament images produced by the representative points on the intersecting line father away from the origin O are indicated by a solid line; filament images produced by the representative points on the intersecting line closer to the origin O are indicated by a one dot chain line; and filament images produced by the representative points on the boundary (y=0) are indicated by a two dot chain line. And a large number of these filament images collectively form the pattern 27R shown in FIG. 19.

Figure 33:
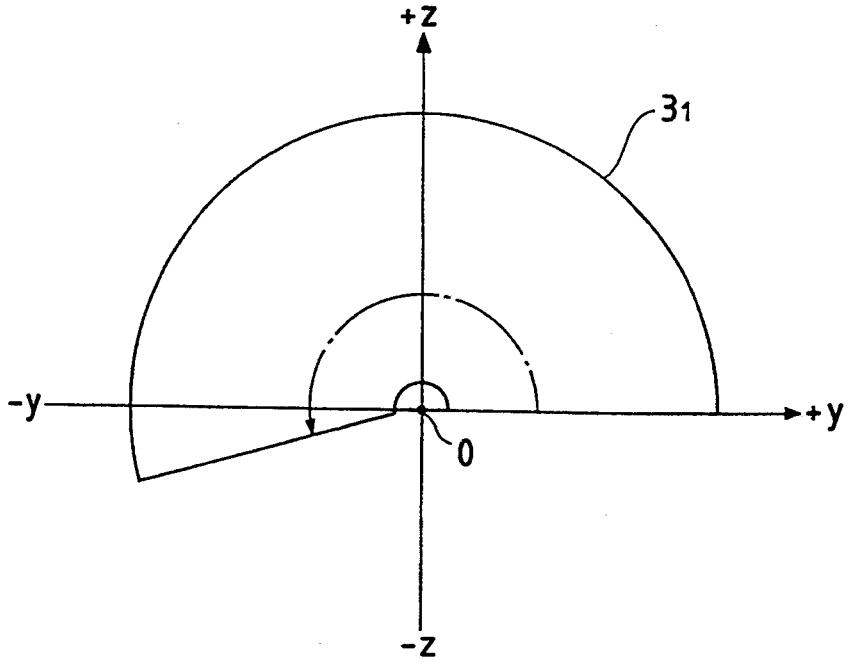
FIG. 33 is a front view showing an upper reflecting sector $3_1$.
Figure 34:
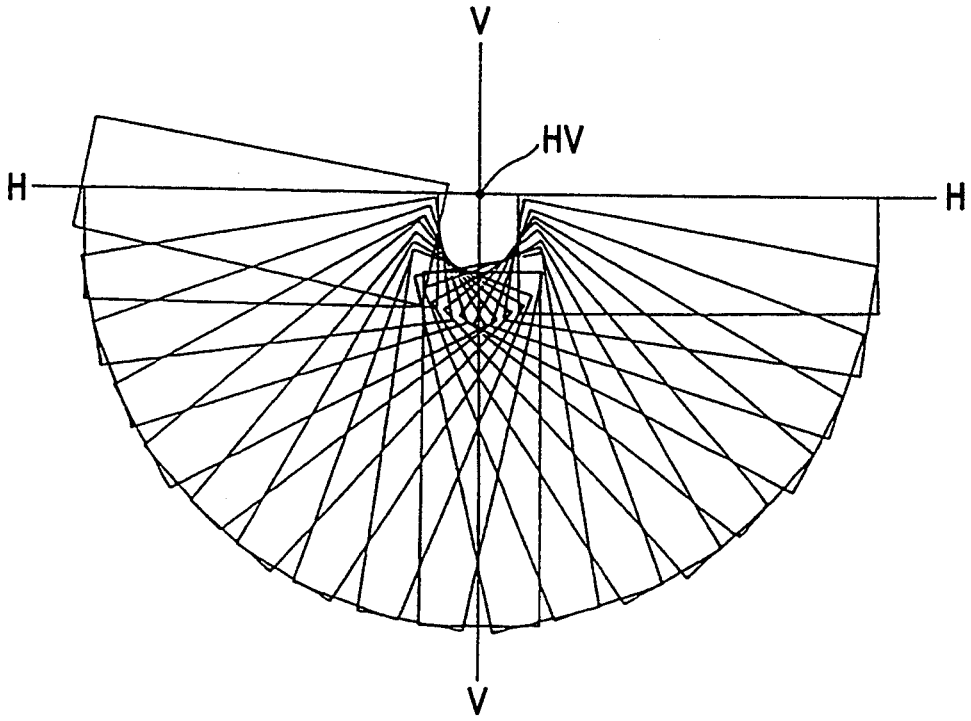
FIG. 34 is a diagram showing the arrangement of filament images by the reflecting sector $3_1$.

FIG. 33 is a front view of the reflecting sector $3_1$. FIG. 34 shows filament images produced by representative points located, at a predetermined interval, on an arc shown by the one dot chain line in FIG. 33. These filament images correspond to the pattern 28 shown in FIG. 19, a conventionally well known pattern.

FIGS. 35–38 show luminous intensity distributions of light-distribution patterns in the form of isocandela curves, which were produced by an experimentally fabricated reflector.

Figure 35:
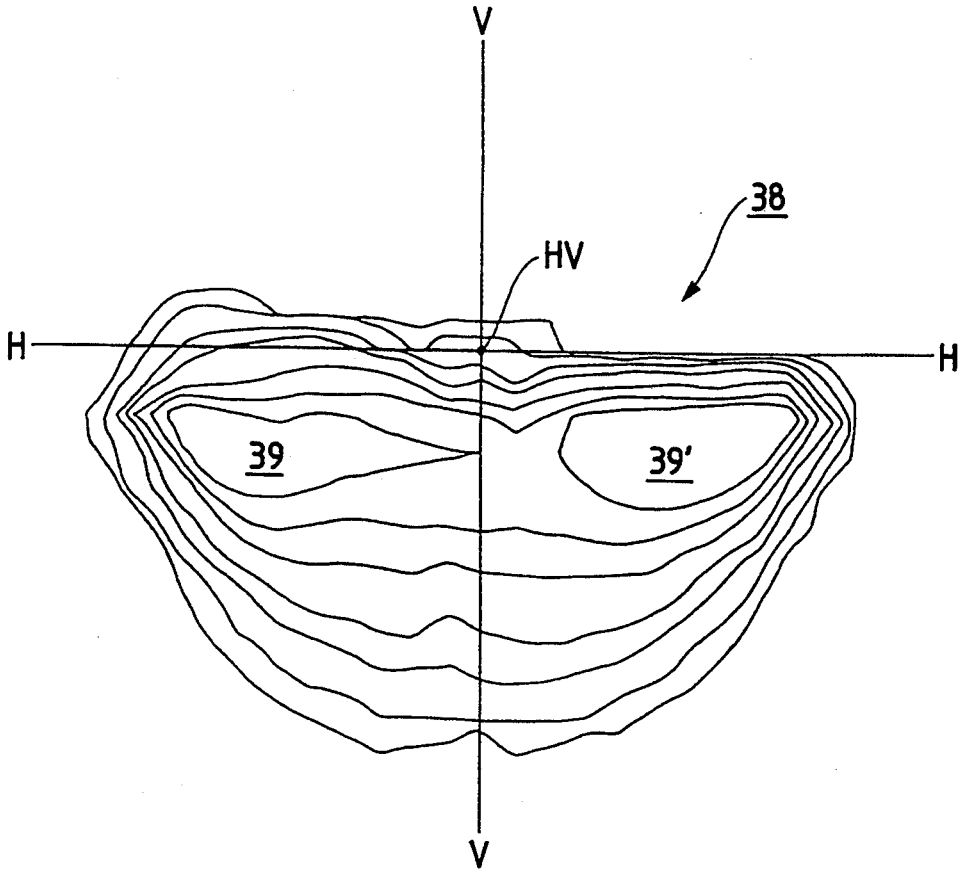
FIG. 35 is a diagram showing an entire light-distribution pattern of the invention.

FIG. 35 shows an entire light-distribution pattern 38. The luminous intensity distribution includes two brightest zones 39 (left) and 39' (right) located slightly below the horizontal line H—H while interposing the vertical line V—V therebetween. The luminous intensity tends to decrease from the zones 39, 39' toward the periphery.

Figure 36:
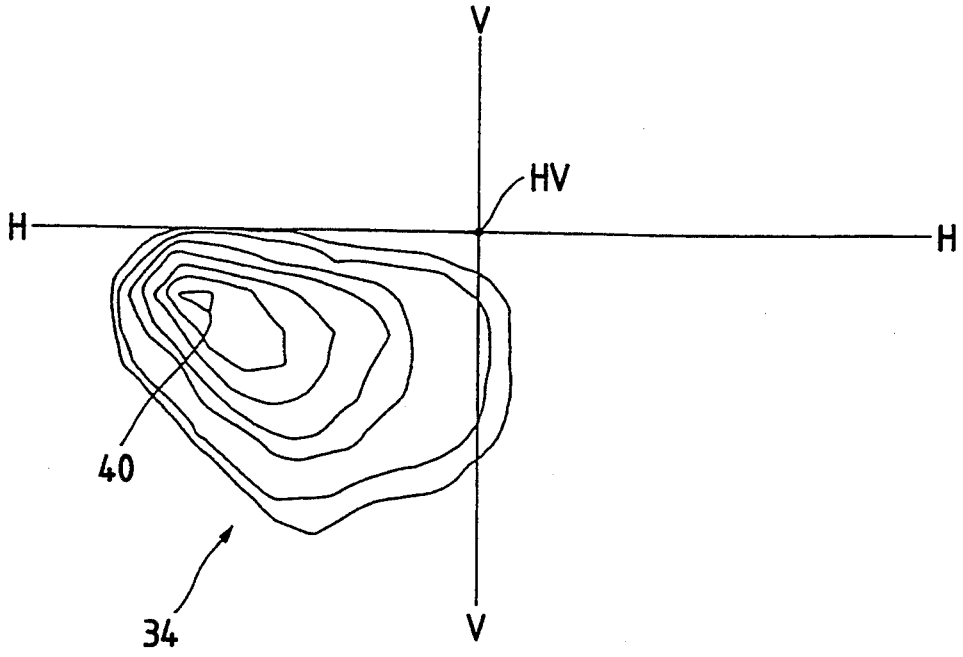
FIG. 36 is a diagram showing a light-distribution pattern by the reflecting sector 4L'.

FIG. 36 shows a luminous intensity distribution of a light-distribution pattern 34 by the sector 4L'. The brightest zone 40 is located at an upper left portion of the pattern and immediately below the horizontal line H—H, exhibiting a tendency that the luminous intensity decreases toward the periphery.

Figure 37:
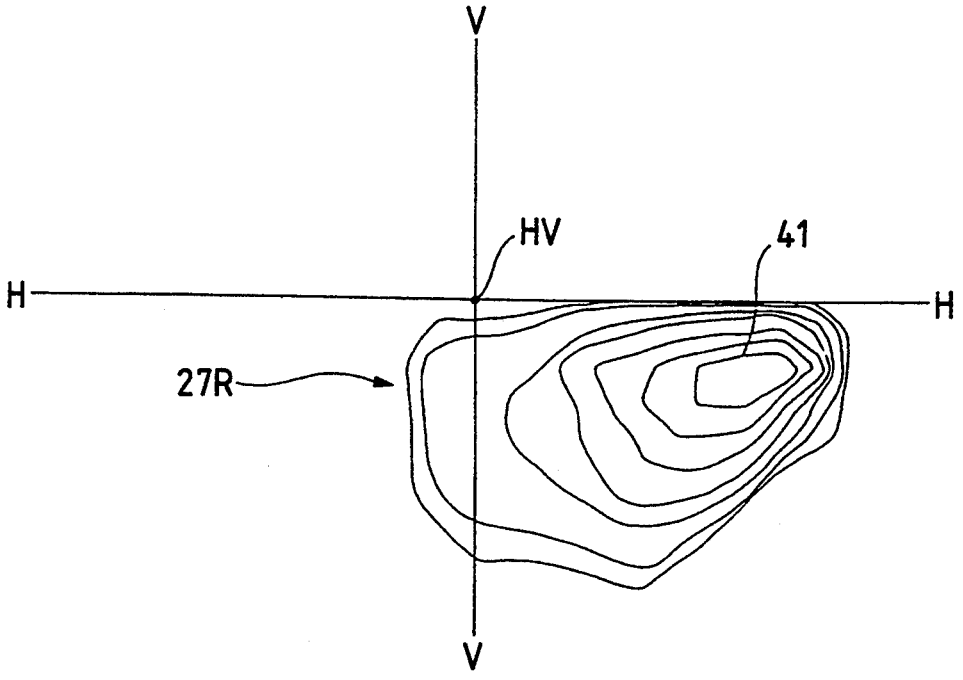
FIG. 37 is a diagram showing a light-distribution pattern by the reflecting sector 4R.

FIG. 37 shows a luminous intensity distribution of a light-distribution pattern 27R by the sector 4R. The brightest zone 41 is located at an upper right portion of the pattern and immediately below the horizontal line H—H, exhibiting a tendency that the luminous intensity decreases toward the periphery.

Figure 38:
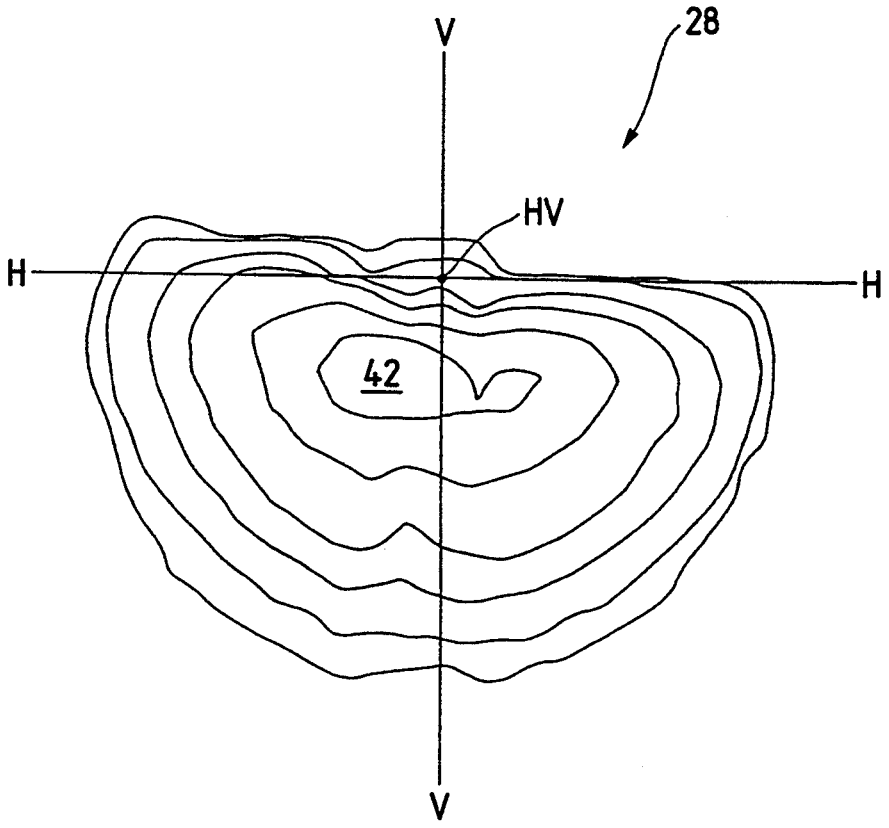
FIG. 38 is a diagram showing a light-distribution pattern by the reflecting sector $3_1$.

FIG. 38 shows a luminous intensity distribution of a light-distribution pattern 28 by the sector $3_1$. The brightest zone 42 is located slightly below the intersection HV of the horizontal line H—H and the vertical line V—V.

These three patterns are combined to produce the light-distribution pattern shown in FIG. 35.

By the way, in a slant-nosed headlight in which an outer lens, that is disposed in front of a reflector, is largely inclined, it is not possible to form, on the outer lens, lens steps having a strong horizontal diffusion effect. Therefore, it is required that such a diffusion effect be provided by the reflector.

A reflecting surface will be described below which has the reflecting surface expressed by Formula 15 as a basic surface, and which has an improved diffusion effect and is less likely to produce glare.

Figure 39:
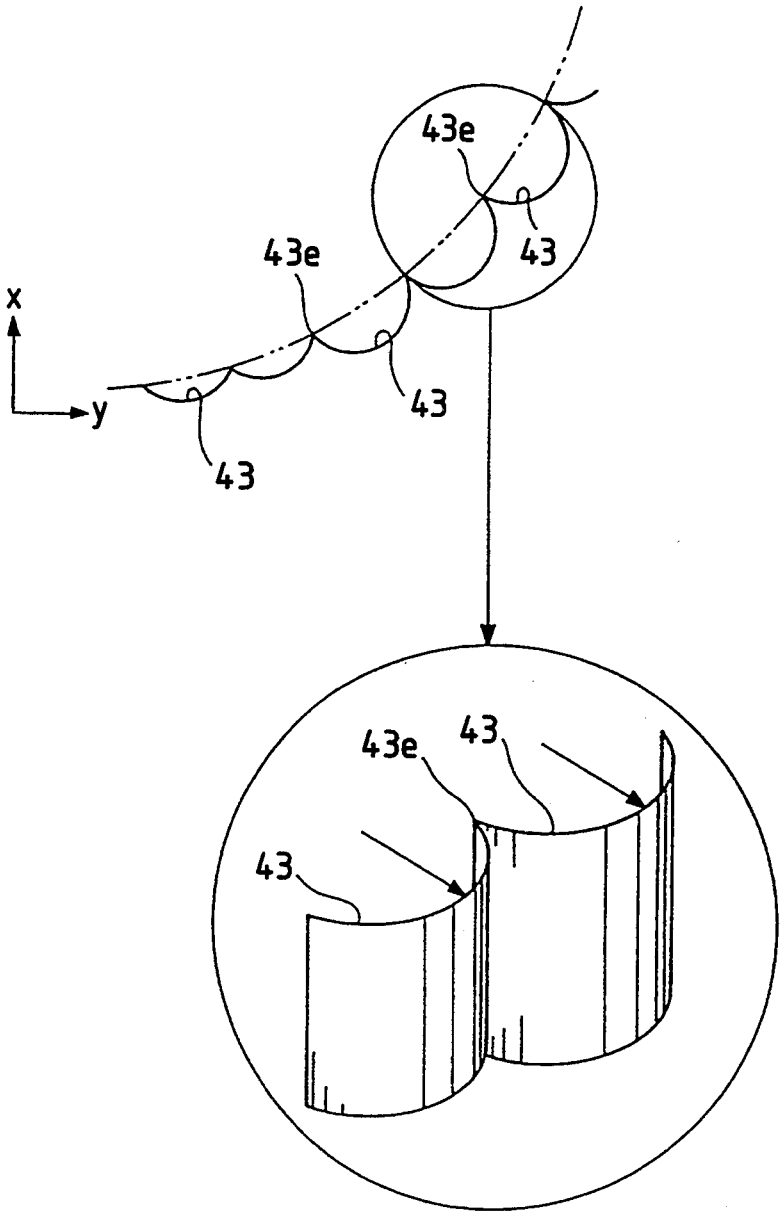
FIG. 39 is a schematic diagram showing an exemplary reflecting surface that is provided with a diffusion effect by forming curved recesses thereon.

One well known technique for providing a reflector having a light diffusion effect is to scrape the surface of a reflector to a certain depth by, e.g., a ball-end mill so that concave recesses 43, 43, . . . as shown in FIG. 39 are formed on the surface. However, this causes a boundary **43*e*** between the adjacent recesses to be a sharp edge (or a surface with an extremely small curvature). As a result, in depositing a reflecting layer in the process of forming a reflecting surface, the thickness of the reflecting layer will not be uniform but will have an irregular distribution, thereby causing glare.

Conventionally, overcome this problem, a technique of changing the depth of the recess 43 in accordance with its location as shown in FIG. 39, is adopted to reduce stray light produced by the recesses. However, where this technique is applied to a concave surface having a certain curvature, it is difficult to precisely control the degree of light diffusion in a desired manner, and so the desired light-distribution is not easily achieved.

According to the invention, the following technique is employed to provide a reflecting surface having a light diffusion effect, which can be designed easily while preventing the occurrence of glare.

A normal distribution type function Aten(X,W) using parameters X, W is first introduced as shown in Formula 16.

$$Aten(X,W) = \exp\left[-\left(\frac{2X}{W}\right)^2\right] \quad \text{[Formula 16]}$$

Figure 40:
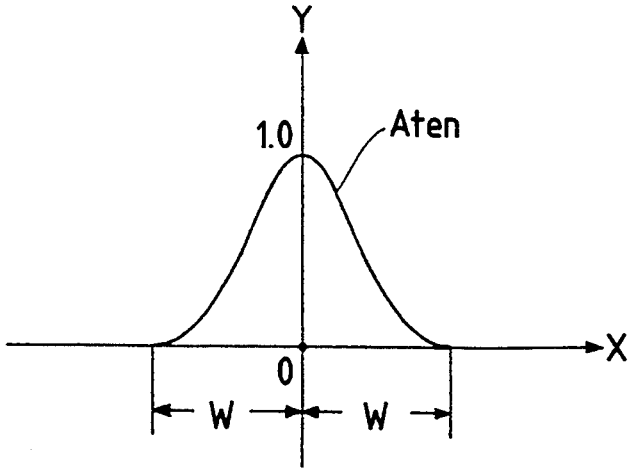
FIG. 40 is a graph schematically showing a normal distribution type function Aten(X,W)

The parameter W defines the degree of damping. When $X=\pm W$, the function Aten takes a value as small as $\exp(-4)\approx 0.018$. The form of a function Y=Aten(X,W) is shown in FIG. 40.

Next, a periodic function WAVE(X, Freq) using a parameter Freq is introduced, as shown in Formula 17.

$$\mathrm{WAVE}(X, Freq) = \frac{1-\cos\left(360^\circ \cdot \frac{X}{Freq}\right)}{2} \quad \text{[Formula 17]}$$

Figure 41:
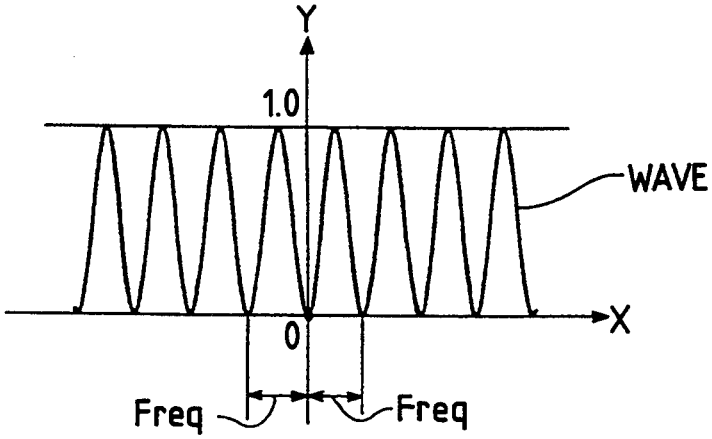
FIG. 41 is a graph schematically showing a periodic function WAVE(X, Freq)

The parameter Freq represents a cycle of a cosine wave, i.e., an interval of the wave. The form of a function Y=WAVE(X, Freq) is shown in FIG. 41. Although the cosine function is used as the periodic function WAVE in this example, various types of periodic functions may be used where appropriate.

A function Damp(X, Freq, Times) is defined as a multiplication of Formula 16 and Formula 17, where Freq. Times is substituted for W, as shown in Formula 18.

$$\mathrm{Damp}(X, Freq, \mathrm{Times}) = \quad \text{[Formula 18]}$$

$$Aten(X, \mathrm{Freq}\cdot\mathrm{Times})\cdot \mathrm{WAVE}(X, Freq) =$$

$$\exp\left[-\left(\frac{2X}{Freq\cdot\mathrm{Times}}\right)^2\right]\cdot\frac{1-\cos\left(360^\circ\cdot\frac{X}{Freq}\right)}{2}$$

Figure 42:
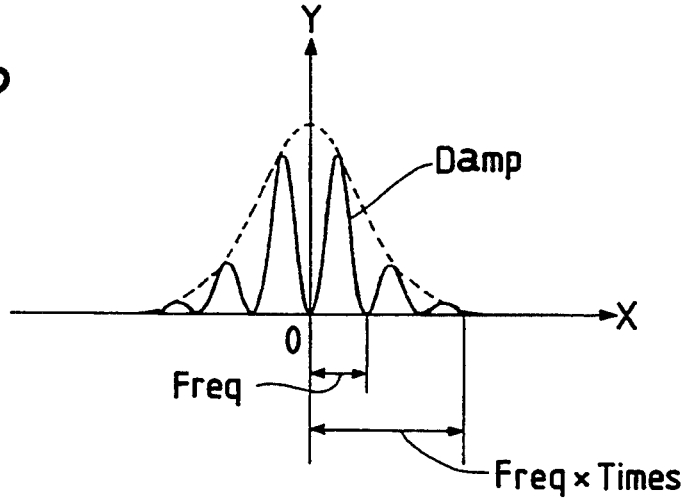
FIG. 42 is a graph schematically showing a damped periodic function Damp(X, Freq, Times)

The function Y=Damp(X, Freq, Times) is a periodic function that attenuates with X=0 as the peak, as shown in FIG. 42.

A reflecting surface under consideration is based on the equations of the basic surface, and is given the diffusion effect by adding the above damping periodic function to the basic equations. As a result, a light-distribution control is effected such that a light ray reflected at a portion close to the center of the reflecting surface is diffused in the horizontal direction while a light ray reflected at a portion distant from the center contributes to the formation of a brightest "hot zone".

The equations of the reflecting surface shown in Formula 15 can be expressed as a general form of Formula 19 using parameters q and h.

$$x = x(q,h) \quad y = y(q,h) \quad z = z(q,h) \qquad \text{[Formula 19]}$$

Now, a function SEIKI(y,z) for providing the diffusion effect to this reflecting surface is introduced, and a reflecting surface expressed as Formula 20 is assumed.

$$x = x(q,h) - SEIKI(y,z) \quad y = y(q,h) \quad z = z(q,h) \qquad \text{[Formula 20]}$$

Figure 43:
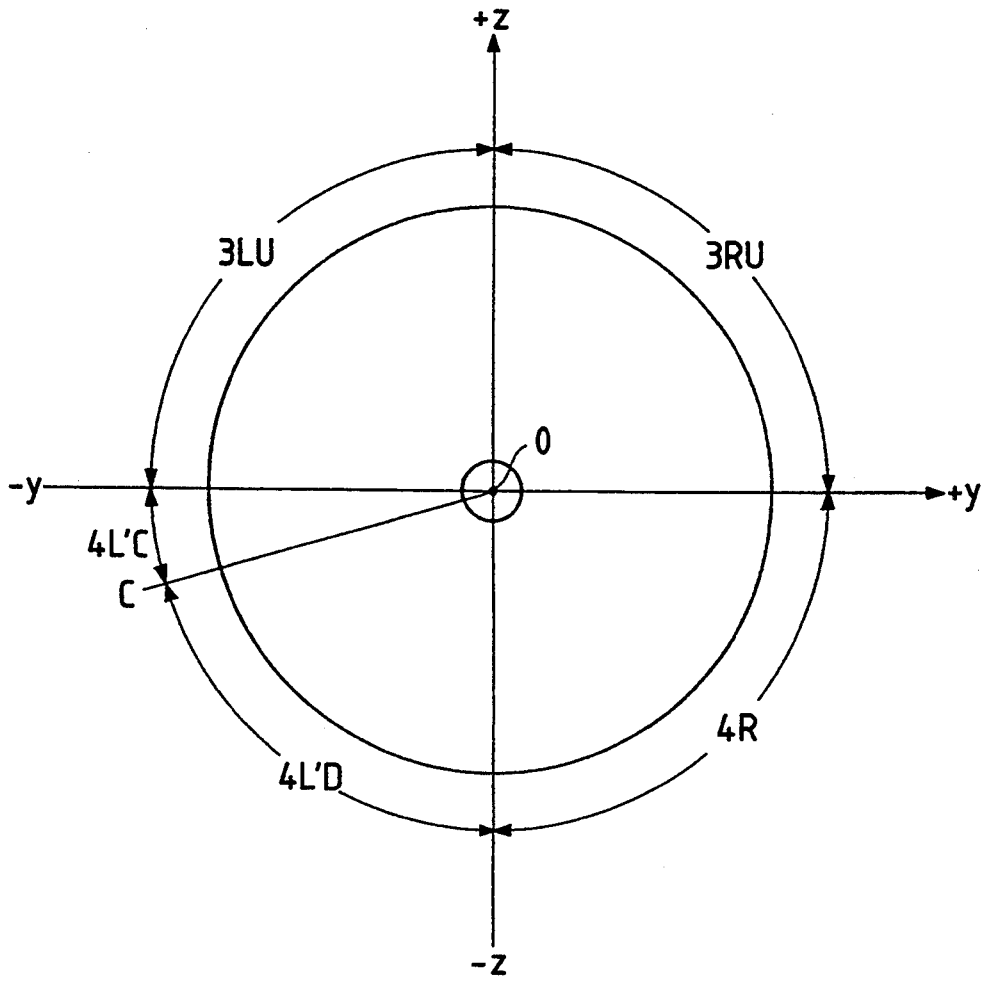
FIG. 43 is a front view of a reflecting surface illustrative of the division of reflecting sectors for a function SEIKI(y,z)

If the above-described reflecting surface 1 is divided into five sectors 3RU ($\beta=0°$ to 90°), 3LU ($\beta=90°$ to 180°), 4L'C ($\beta=180°$ to 195°), 4L'D ($\beta=195°$ to 270°) and 4R ($\beta=270°$ to 360°) as shown in FIG. 43 (the values in parentheses represent the ranges in terms of the aforesaid parameter $\beta$), then the function SEIKI(y,z) for providing the diffusion effect is expressed as Table 6.

TABLE 6

Definition of Function SEIKI(y,z)

| Sector | Function |
|---|---|
| 3RU | Aten(z,wave_u_ratio) × df_R × Damp(y,wave_R, Times_R) |
| 3LU | Aten(z,wave_u_ratio) × df_L × Damp(y,wave_L, Times_L) |
| 4L'C | Aten(z,wave_d_ratio) × df_L × Damp($\sqrt{y^2+z^2}$, wave_L, Times_L) |
| 4L'D | Aten(z,wave_d_ratio) × df_l × Damp(y/cos$\theta$,wave_L, Times_L) |
| 4R | Aten(z,wave_d_ratio) × df_R × Damp(y,wave_R, Times_R) |

The definition of the parameters used in the functions in Table 6 are shown in Table 7.

TABLE 7

Definition of Parameters

| Parameter | Definition |
|---|---|
| wave_u_ratio | Defines degree of damping of wave in z-direction in region where z > 0 |
| wave_d_ratio | Defines degree of damping of wave in z-direction in region where z < 0 |
| df_L | Defines wave height in region where y < 0 |
| df_R | Defines wave height in region where y > 0 |
| wave_L | Defines wave gap in region where y < 0 |
| wave_R | Defines wave gap in region where y > 0 |
| Times_L | Defines how many times it takes to cause wave to disappear in region where y < 0 |
| Times_R | Defines how many times it takes to cause wave to disappear in region where y > 0 |

Symbols "_L" and "_R" in the parameters in Table 7 mean "left side" and "right side", respectively when the reflector is viewed from the front, i.e., from the positive side of the x-axis.

Figure 44:
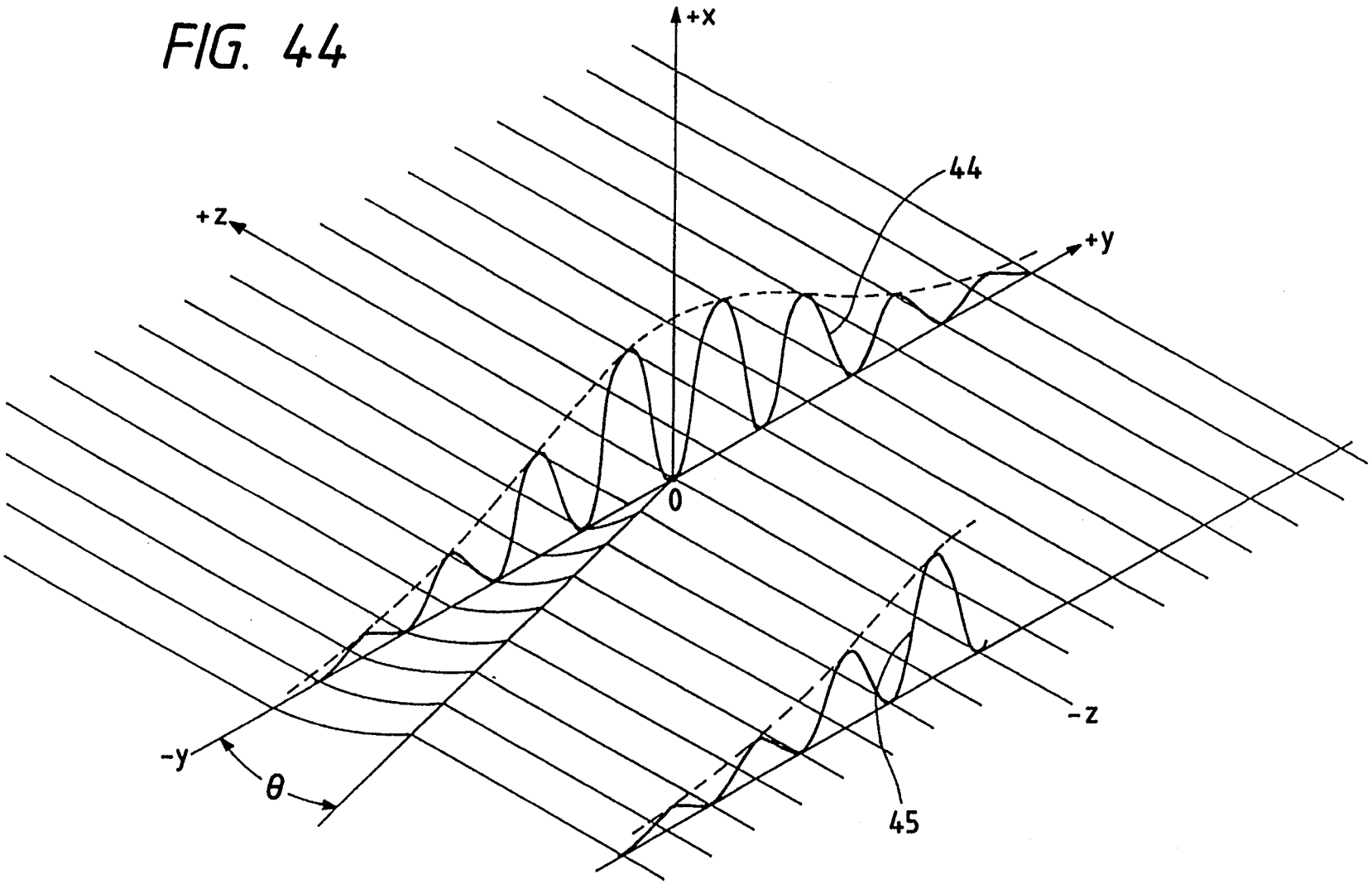
FIG. 44 is a graph conceptually showing the configuration of the function SEIKI(y,z)

FIG. 44 is a diagram conceptually showing the configuration of the function x=SEIKI(y,z). A graphic curve 44 represents a cross sectional configuration when z=0, while a graphic curve 45 represents a cross sectional configuration when z is constant in the sector 4L'D.

When the reflecting surface expressed by Formula 15 is given the diffusion effect by the addition of the function SEIKI(y,z), pattern images produced by means of computer graphics, each of whose contour is a collection of filament images, are as depicted in FIGS. 46, 48, 50 and 52.

Figure 45:
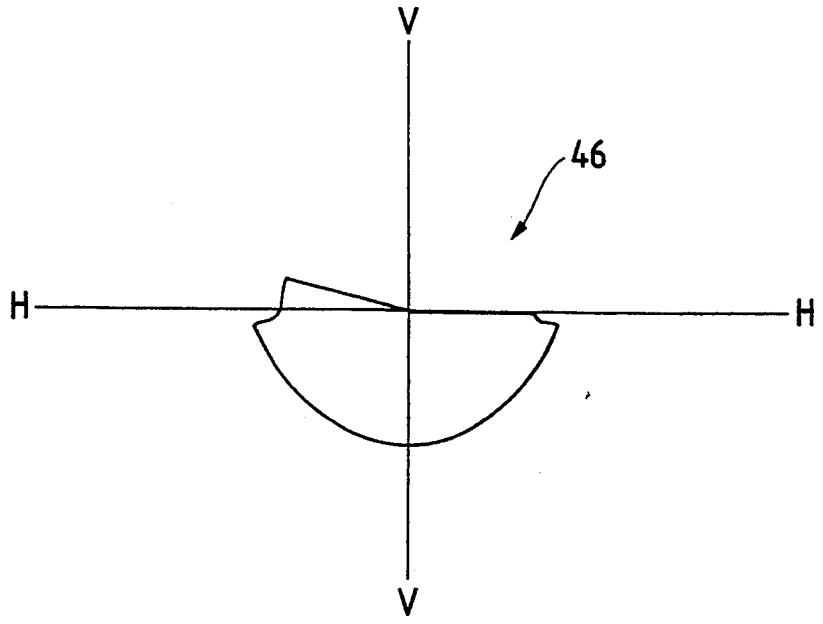
FIG. 45 is a diagram showing an entire pattern image by a basic reflecting surface expressed by Formula 15 and Table 5.
Figure 46:
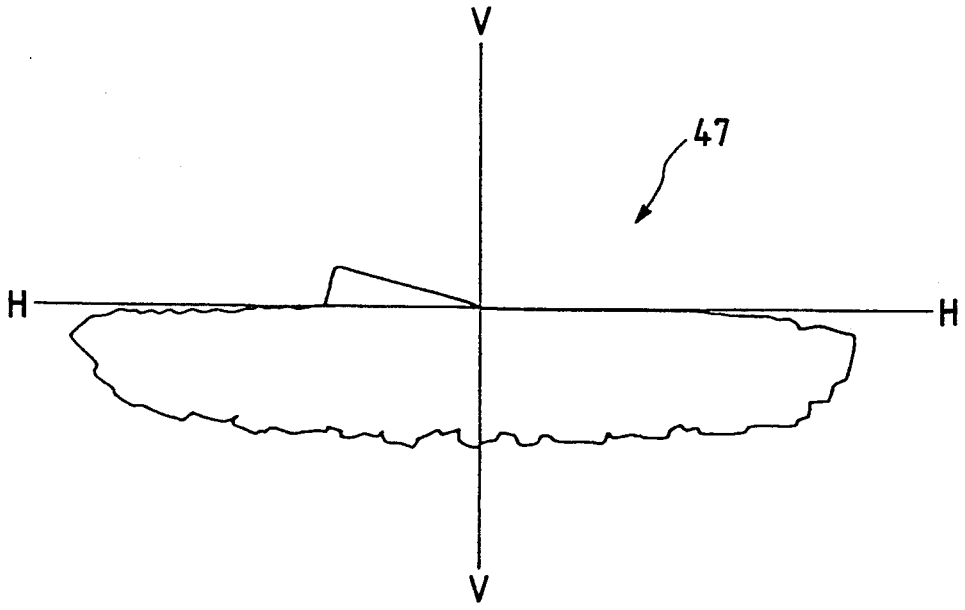
FIG. 46 is a diagram showing an entire pattern image by a reflecting surface obtained by adding the function SEIKI shown in Table 6.

FIG. 45 shows an entire pattern image 46 produced by the basic reflecting surface expressed by Formula 15 and Table 5. FIG. 46 shows an entire pattern image 47 produced by an irregular reflecting surface obtained as a result of adding to the basic surface the surface expressed by the function SEIKI shown in Table 6, according to Formula 20. Comparing FIGS. 45 and 46, a significant diffusion effect is observed in a direction extending in parallel with the horizontal line H—H, and it is understood that most of the light-distribution pattern including the cutline is formed by the reflecting surface.

Figure 47:
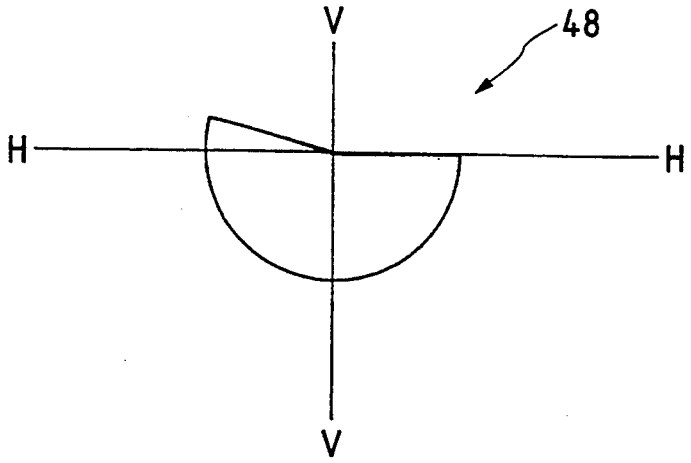
FIG. 47 is a diagram showing a pattern image by the sector $3_1$ of the basic reflecting surface.
Figure 48:
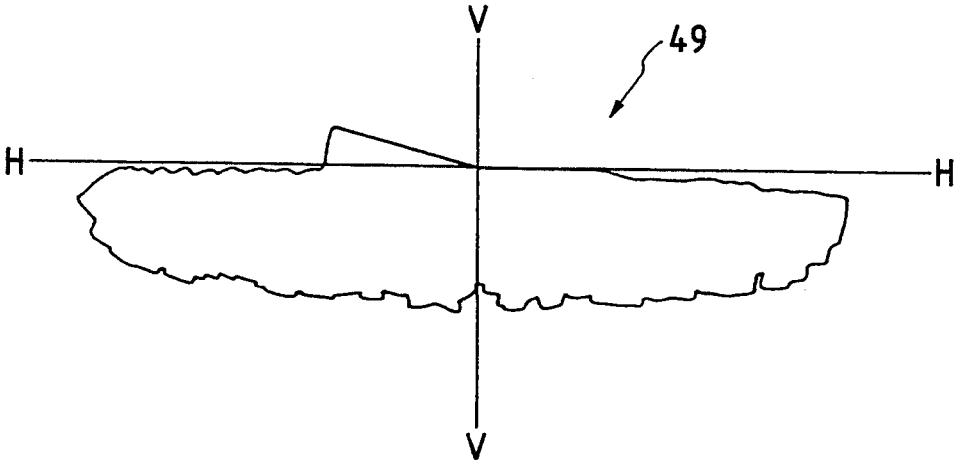
FIG. 48 is a diagram showing a pattern image by the sector $3_1$ after the sector $3_1$ has been provided with the diffusion effect by the function SEIKI.

FIG. 47 shows a pattern image 48 by the sector $3_1$ of the basic reflecting surface. A pattern image 49 obtained after the diffusion effect has been given by the function SEIKI becomes a pattern as shown in FIG. 48, in which a portion below the horizontal line expands in the horizontal direction.

Figure 49:
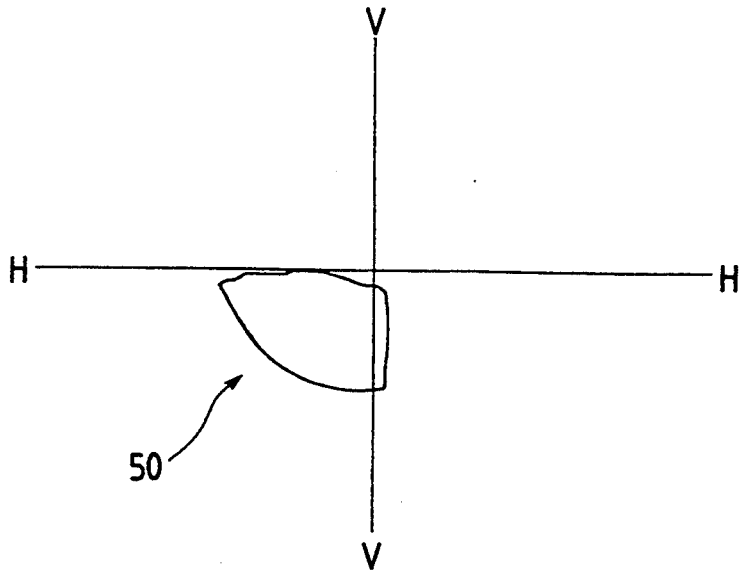
FIG. 49 is a diagram showing a pattern image obtained by the sector 4L' of the basic reflecting surface.
Figure 50:
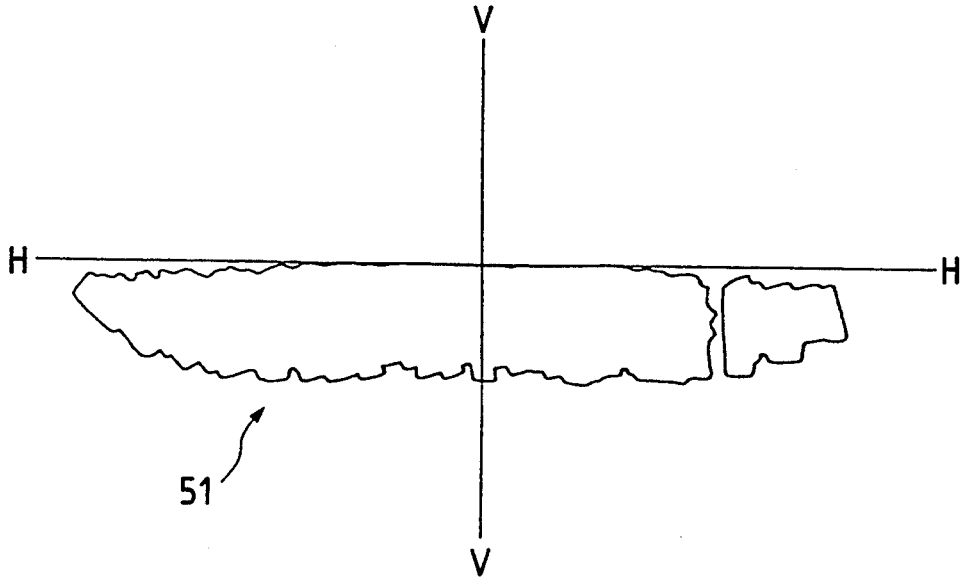
FIG. 50 is a diagram showing a pattern image by the sector 4L' after the sector 4L' has been provided with the diffusion effect by the function SEIKI.
Figure 51:
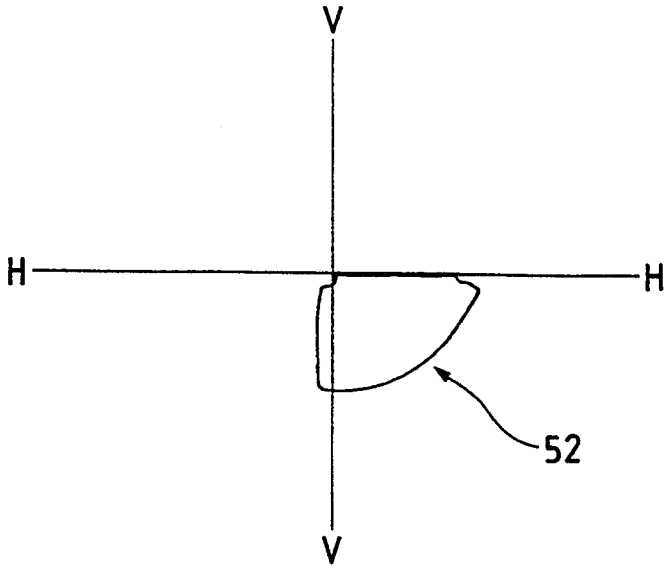
FIG. 51 is a diagram showing a pattern image obtained by the sector 4R of the basic reflecting surface.
Figure 52:
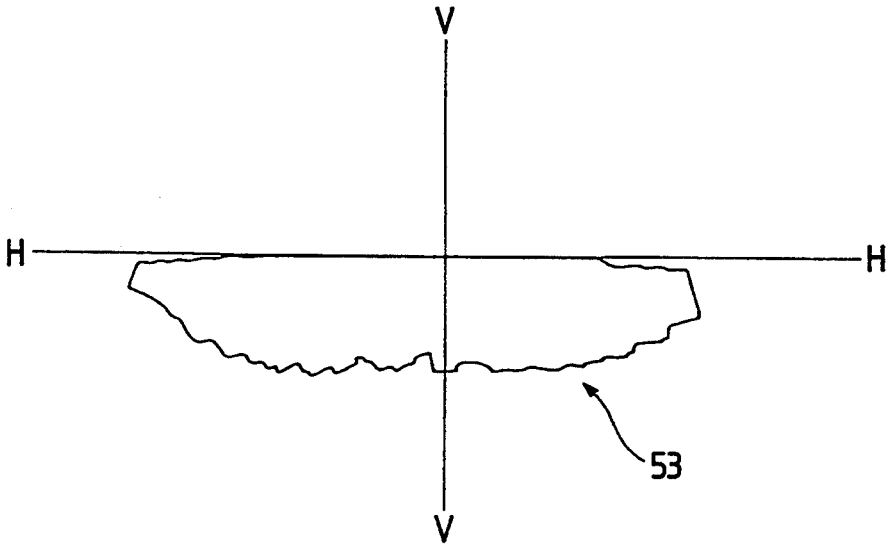
FIG. 52 is a diagram showing a pattern image obtained by the sector 4R after the sector 4R has been provided with the diffusion effect by the function SEIKI.

FIG. 49 shows a pattern image 50 by the sector 4L' of the basic reflecting surface, which becomes a pattern image 51 shown in FIG. 50 after the diffusion effect has been given. FIG. 51 shows a pattern image 52 by the sector 4R of the basic reflecting surface, which becomes a pattern image 53 shown in FIG. 52 after the diffusion effect has been given. In either case, there is noticeable diffusion in the horizontal direction, with the pattern image 51 exhibiting more conspicuous diffusion.

FIGS. 53–56 show luminous intensity distributions in the form of isocandela curves of light-distribution patterns obtained by an experimentally fabricated reflector.

Figure 53:
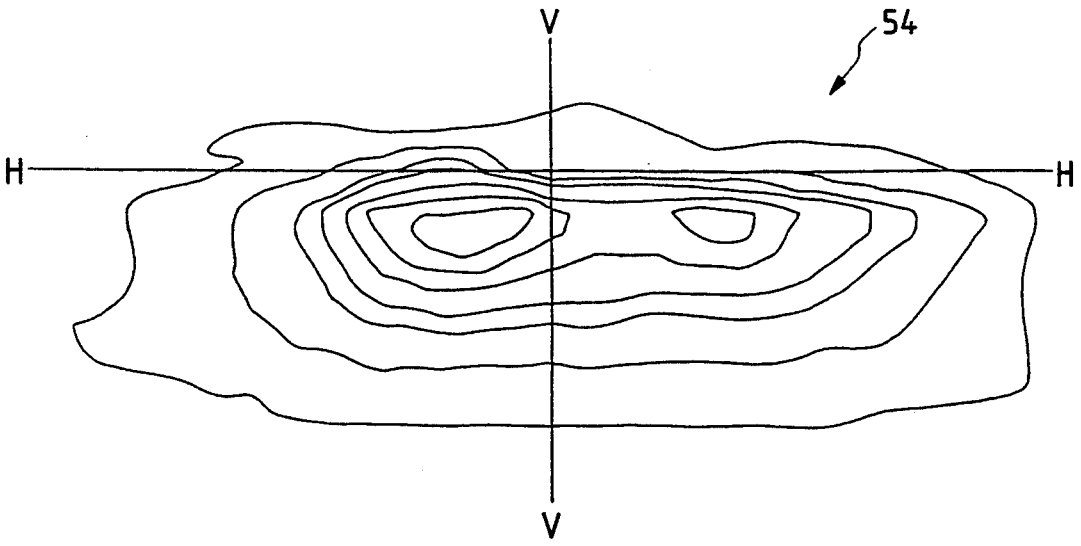
FIG. 53 is a diagram showing an entire reflecting pattern obtained by an experimentally fabricated reflector having a diffusion effect.

FIG. 53 shows an entire light-distribution pattern 54, in which a brightest zone is located immediately below the horizontal line H—H and slightly on the left of the vertical line V—V.

Figure 54:
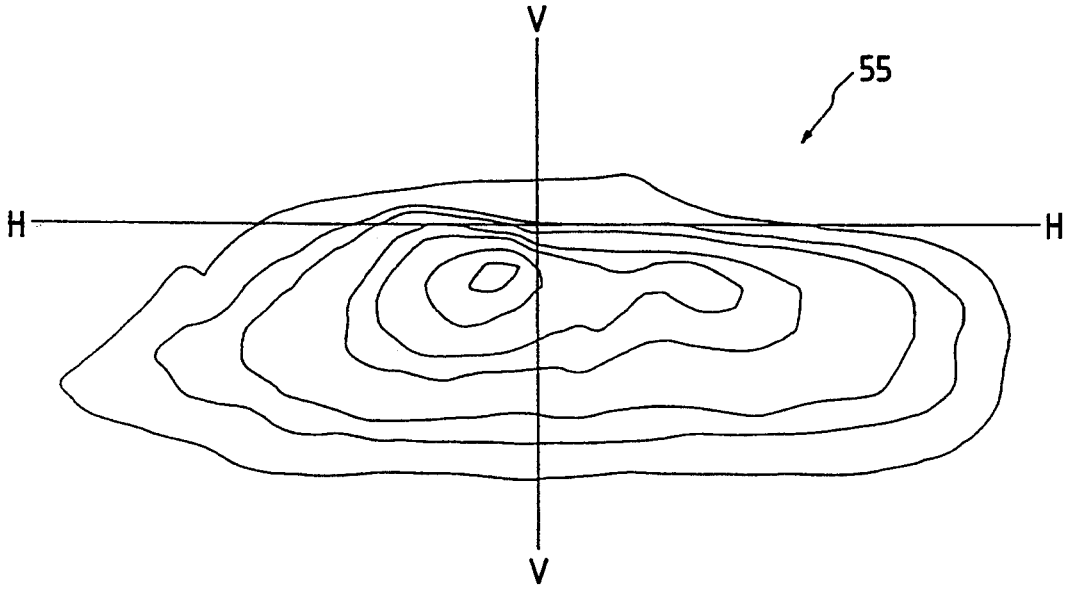
FIG. 54 is a diagram showing a light-distribution pattern by the sector $3_1$ out of the entire pattern shown in FIG. 53.

FIG. 54 shows a light-distribution pattern 55 by the sector $3_1$, in which a brightest zone is located immediately below the horizontal line H—H and immediately on the left of the vertical line V—V. But the luminous intensity distribution develops over an wide area below the horizontal line H—H.

Figure 55:
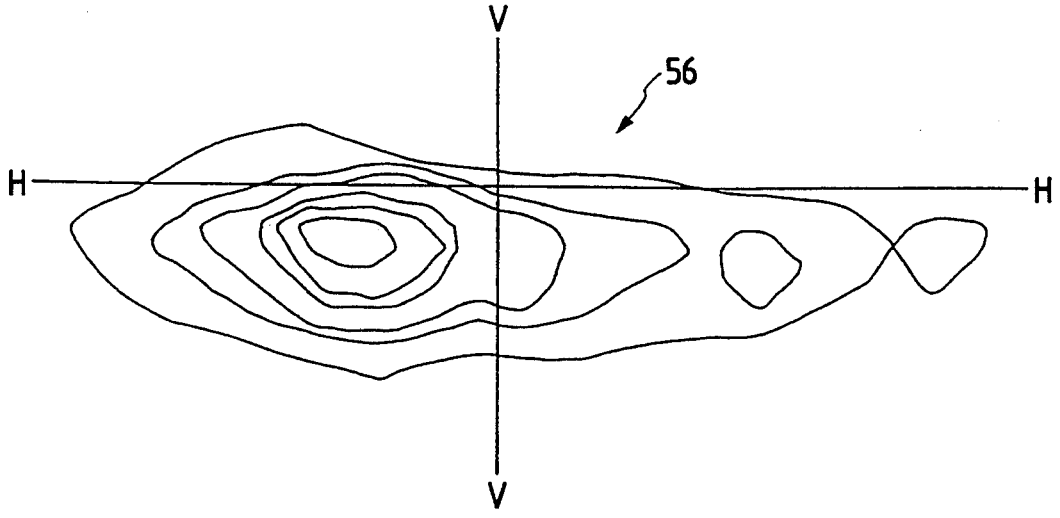
FIG. 55 is a diagram showing a light-distribution pattern by the sector 4L' out of the entire pattern shown in FIG. 53.

FIG. 55 shows a light-distribution pattern 56 by the sector 4L', which is distributed below the horizontal line and mainly on the left of the vertical line V—V.

Figure 56:
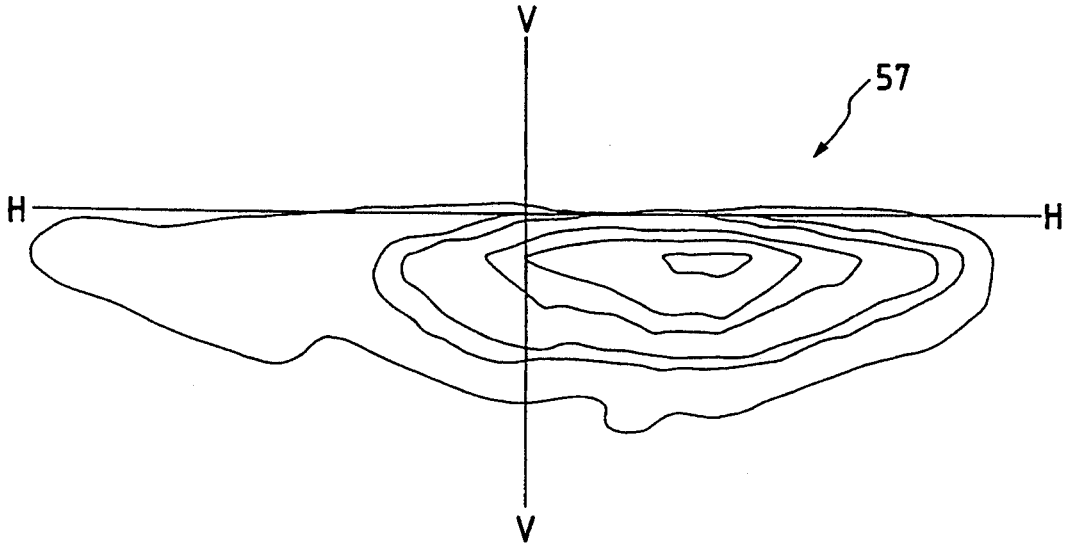
FIG. 56 is a diagram showing a light-distribution pattern by the sector 4R out of the entire pattern shown in FIG. 53.
Figure 57:
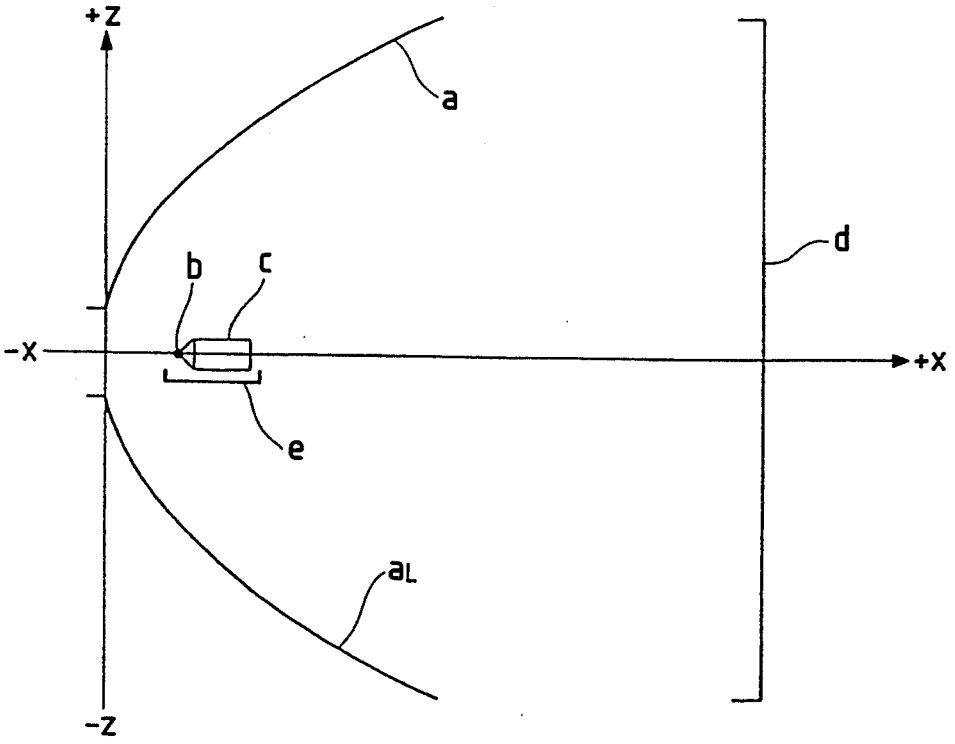
FIG. 57 PRIOR ART
FIG. 57 is a schematic diagram showing the construction of a headlight with a paraboloid-of-revolution reflector.
Figure 58:
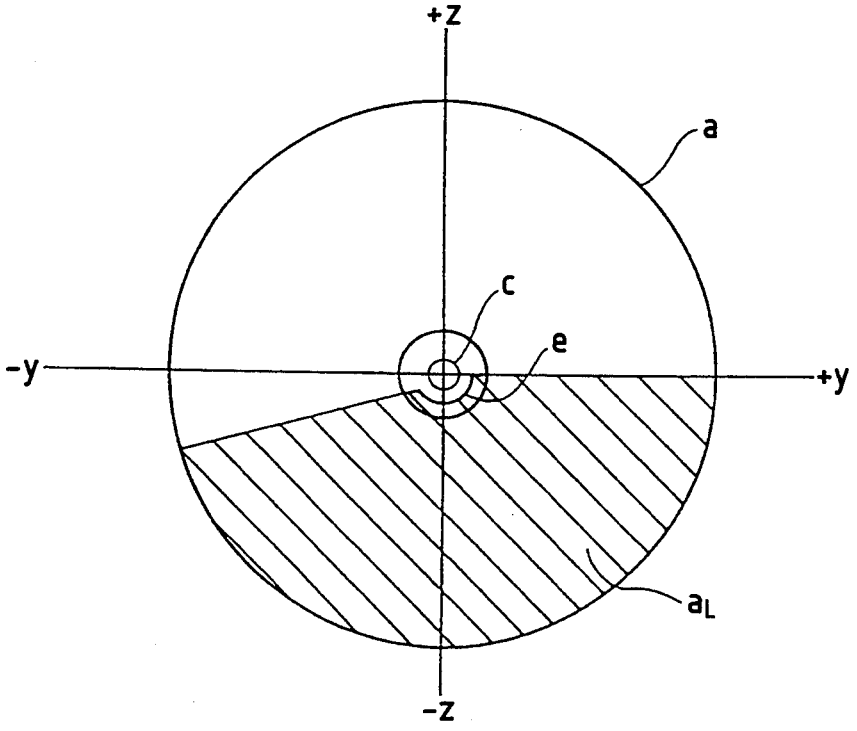
FIG. 58 PRIOR ART
FIG. 58 is a front view of the paraboloid-of-revolution reflector.
Figure 61:
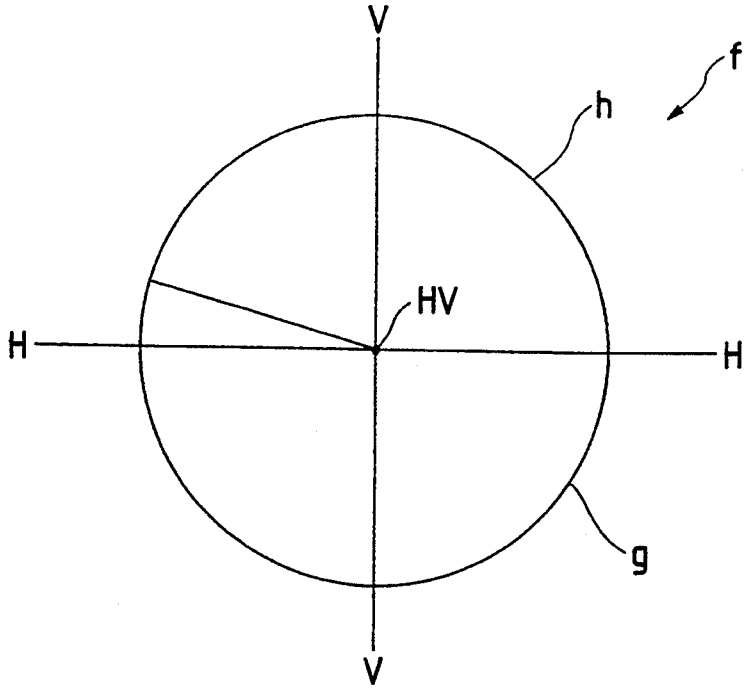
FIG. 61 is a diagram showing a pattern image by the paraboloid-of-revolution reflector when no shade is used.
Figure 62:
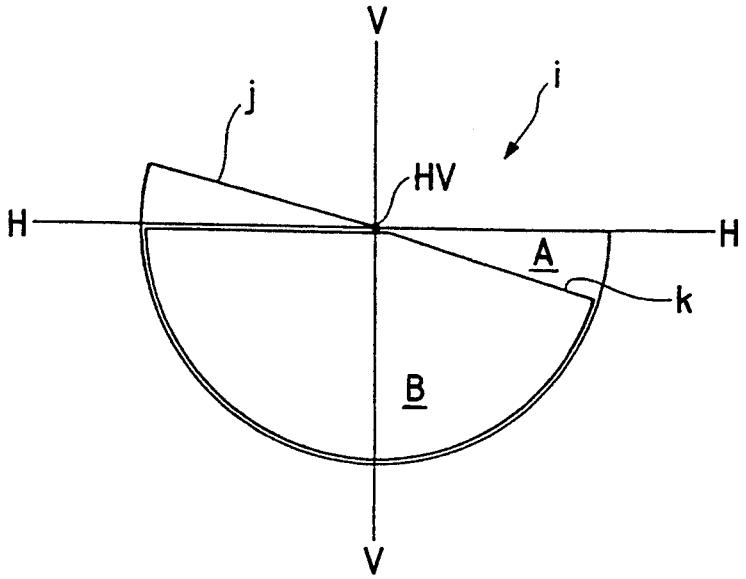
FIG. 62 is a diagram illustrative of problems in the prior art.

FIG. 56 shows a light-distribution pattern 57 by the sector 4R, which is distributed, contrary to FIG. 56, mainly on right of the vertical line V—V.

In the above example, the configuration of a normal distribution wave is of a plane wave type, i.e., of a type that the peak of the wave varies along the y-axis, except for the sector 4L'C. To obtain a configuration of an elliptical type ("circular" is included in the word "elliptical"), a function x=SEIKI (y,z) shown in Table 8 may be used.

TABLE 8

| Sector | Definition of Function SEIKI(y,z) Function |
|---|---|
| 3RU | $\text{Aten}(\sqrt{y^2 + (z/\text{wave}_u)^2}, \text{wave_radius}) \times \text{Damp}(y, \text{wave_R}, \text{MAXIM}) \times \text{df_R}$ |
| 3LU | $\text{Aten}(\sqrt{y^2 + (z/\text{wave}_u)^2}, \text{wave_radius}) \times \text{Damp}(y, \text{wave_L}, \text{MAXIM}) \times \text{df_L}$ |
| 4L'C | $\text{Aten}(\sqrt{y^2 + (z/\text{wave_D})^2}, \text{wave_radius}) \times \text{Damp}(\sqrt{y^2 + z^2}, \text{wave_L}, \text{MAXIM}) \times \text{df_L}$ |
| 4L'D | $\text{Aten}(\sqrt{y^2 + (z/\text{wave_D})^3}, \text{wave_ radius}) \times \text{Damp}(y/\cos\theta, \text{wave_L}, \text{MAXIM}) \times \text{df_ L}$ |
| 4R | $\text{Aten}(\sqrt{y^2 + (z/\text{wave_D})^2}, \text{wave_ radius}) \times \text{Damp}(y, \text{wave_ R}, \text{MAXIM}) \times \text{df_R}$ |

The definition of the newly introduced parameters in Table 8 is shown in Table 9.

TABLE 9

| Parameter | Definition of Parameters Definition |
|---|---|
| wave_U | Defines elliptical configuration of wave in region where $z > 0$ |
| wave_D | Defines elliptical configuration of wave in region where $z < 0$ |
| wave_radius | Defines degree of damping of wave in radial direction with origin 0 as reference |
| MAXIM | Sufficiently large value in Damp function selected so that wave does not disappear immediately |

With respect to each of the parameters "$\text{wave}_{13}$ U" and "wave_D", if it is equal to 1, a circular wave is obtained; if it is greater than 1, an elliptical wave that is elongated in the z-axis direction is obtained; and if it is smaller than 1, an elliptical wave that is elongated in the y-axis direction is obtained.

While the reflector whose front-view configuration is circular has mainly been described in the above embodiments, the invention may, of course, be applied to a rectangular reflector. In addition, any embodiments will be included in the technological scope of the invention as long as they do not deviate from the gist of the invention. For example, a reflecting surface of the invention may comprise one or more reflector sectors that comprise a multiplicity of reflecting sub-sectors.

The entire disclosure of each and every foreign patent application from which the benefit of foreign priority has been claimed in the present application is incorporated herein by reference, as if fully set forth.

Although this invention has been described in at least one preferred form with a certain degree of particularity, it is to be understood that the present disclosure of the preferred embodiment has been made only by way of example and that numerous changes in the details and arrangement of components may be made without departing from the spirit and scope of the invention as hereinafter claimed.

What is claimed is:

1. A vehicular headlight comprising a reflector having a plurality of continuously connected reflecting surfaces, and a light source with a longitudinal dimension along an optical axis of said reflector, said reflector comprising:

a first reflecting surface generally occupying an upper half of said reflector, and a second reflecting surface located below a boundary line with said first reflecting surface extending from a vertex of said reflector, said first and second reflecting surfaces being connected to each other at said boundary line, and being operative to contribute to formation of a pattern image below a cutline and a first half of a horizontal line of a low beam light-distribution pattern, said first and second reflecting surfaces being shaped so that:

a first image of said light source formed after reflection at a first point on said first reflecting surface immediately adjacent to the boundary line contributes to formation of said cutline, and a second image of said light source formed after reflection at a second point on said second reflecting surface immediately adjacent to said boundary line and below said first point is located immediately below a second half of said horizontal axis of said low beam light-distribution pattern and extends substantially in parallel with said first image, wherein said first and second points are located on an arbitrary vertical line obtained by cutting said first and second reflecting surfaces by a vertical plane in parallel with said optical axis.

2. The vehicular headlight of claim 1, wherein said second reflecting surface is shaped so that an image of said light source rotates about a point proximate to said second half of said horizontal line as a reflection point on said second reflecting surface moves from said second point downward on said vertical line.

3. The vehicular headlight of claim 1, wherein said first reflecting surface is part of a paraboloid of revolution, and said light source is located on a side of a focus of said paraboloid of revolution opposite to said vertex of said reflector.

4. The vehicular headlight of claim 1, wherein said boundary line is a collection of inflection points.

5. The vehicular headlight of claim 1, wherein said second reflecting surface is shaped so that as a reflecting point moves along a horizontal line obtained by cutting said second reflecting surface by a horizontal plane in parallel with said optical axis starting on and then away from a vertical plane including said optical axis, an image of said light source starts with a vertical image on a vertical center line of said low beam light-distribution pattern and then moves away from said vertical center line while a top of said image moves more than a bottom thereof so that said image gradually inclines.

* * * * *